US008133824B2

(12) United States Patent
Harber

(10) Patent No.: US 8,133,824 B2
(45) Date of Patent: Mar. 13, 2012

(54) FABRICS AND ARTICLES OF APPAREL INCLUDING DIMENSIONALIZED MESH AND OTHER FABRICS

(75) Inventor: Edward Louis Harber, Portland, OR (US)

(73) Assignee: Nike, Inc., Beaverton, OR (US)

( * ) Notice: Subject to any disclaimer, the term of this patent is extended or adjusted under 35 U.S.C. 154(b) by 422 days.

(21) Appl. No.: 11/424,991

(22) Filed: Jun. 19, 2006

(65) Prior Publication Data

US 2007/0293106 A1 Dec. 20, 2007

(51) Int. Cl.

| | |
|---|---|
| ***D03D 9/00*** | (2006.01) |
| ***D04B 21/10*** | (2006.01) |
| ***D04B 1/22*** | (2006.01) |
| ***D04B 1/24*** | (2006.01) |
| ***B29C 59/00*** | (2006.01) |
| ***A41B 1/00*** | (2006.01) |

(52) U.S. Cl. ..... 442/1; 442/2; 442/304; 442/308; 442/309; 442/327; 66/169 R; 66/170; 66/171; 66/196; 66/202; 156/209; 156/219; 2/DIG. 1; 2/69; 2/113

(58) Field of Classification Search ..... 442/1, 2, 442/304, 308, 309, 327; 428/156, 161, 162, 428/166, 212, 213, 314.2, 314.3; 66/169 R–189, 66/195–202; 156/209, 219
See application file for complete search history.

(56) References Cited

U.S. PATENT DOCUMENTS

| | | | | |
|---|---|---|---|---|
| 1,852,964 | A * | 4/1932 | George | 428/174 |
| 3,568,475 | A * | 3/1971 | Philip | 6/199 |
| 5,399,174 | A * | 3/1995 | Yeo et al. | 604/365 |
| 5,896,680 | A * | 4/1999 | Kim et al. | 36/28 |
| 6,610,390 | B1 * | 8/2003 | Kauschke et al. | 428/198 |
| 7,043,766 | B1 * | 5/2006 | Foreman et al. | 2/81 |
| 2005/0204449 | A1 | 9/2005 | Baron et al. | |
| 2005/0246813 | A1 | 11/2005 | Davis et al. | |
| 2006/0179539 | A1 | 8/2006 | Harber | |
| 2007/0144221 | A1 * | 6/2007 | Sytz | 66/171 |

FOREIGN PATENT DOCUMENTS

| | | | |
|---|---|---|---|
| JP | 2000158577 | A | 6/2000 |
| WO | 9858795 | A | 12/1998 |

OTHER PUBLICATIONS

"Adidas Clima Cool," Internet Citation, [Online] XP-002335963, Retrieved from Internet: URL: http://www.press.adidas.com/en/PortalData/1/Resources//sport_performance/technologies/techsheet_climacool.pdf> [retrieved on Jul. 12, 2005.

International Search Report and Written Opinion in corresponding PCT Application No. PCT/US2007/013791.

International Preliminary Report on Patentability, mailed Jan. 8, 2009.

* cited by examiner

*Primary Examiner* — Angela Ortiz
*Assistant Examiner* — Jennifer Steele
(74) *Attorney, Agent, or Firm* — Banner & Witcoff, Ltd

(57) ABSTRACT

Fabrics and garments may include "dimensionalized" structures. The fabric may be "dimensionalized" by integrally forming a plurality of self-standing fabric surface modifying elements in the fabric material to thereby provide a fabric contact level different from (and/or reduced in surface area as compared to) the fabric base level. Garments may include this "dimensionalized" material, e.g., positioned at various locations to promote better evaporative cooling of the body or heat retention, such as along the wearer's spine, sides, and/or other locations that release substantial heat. The "dimensionalizing" structure may be formed in the material, for example, by molding, rolling, embossing, calendering, stretching, crimping, pressing, heating, and/or the like.

49 Claims, 13 Drawing Sheets

FABRICS AND ARTICLES OF APPAREL INCLUDING DIMENSIONALIZED MESH AND OTHER FABRICS

RELATED APPLICATION DATA

Aspects of the invention described in this patent application relate to and/or may be used in conjunction with aspects of the inventions described in: (a) U.S. patent application Ser. No. 10/839,695 filed May 6, 2004 (entitled "Article of Apparel Utilizing Zoned Venting and/or Other Body Cooling Features or Methods") and/or (b) U.S. patent application Ser. No. 11/059,357 filed Feb. 17, 2005 (entitled "Article of Apparel Utilizing Targeted Venting or Heat Retention Zones that may be Defined Based on Thermal Profiles"). These earlier applications are entirely incorporated herein by reference.

FIELD OF THE INVENTION

Aspects of the present invention generally relate to fabrics and garments that include a three dimensional structure, e.g., to improve a body's evaporative cooling processes to thereby help keep the wearer cool or to improve the thermal insulative properties of the fabric or garment to thereby help keep the wearer warm.

BACKGROUND

One of the biggest challenges athletes face when competing or training, particularly in moderate to hot temperature conditions, is heat. Not only must the athlete cope with heat from the external environment, but he/she also must cope with heat generated within his/her own body as a result of physical exertion.

Substantial heat may be generated in a person's body as a result of physical activity and exertion. In general, a body's core temperature rises with increased physical activity. Typically, less than about 25% of the energy created during physical activity is converted into work energy (e.g., energy used to move the body and/or resist an applied force). The remaining 75%+ of the created energy typically must be dissipated as released heat. The human body's most effective mechanism for dealing with excess heat is through evaporative cooling. When a person's core body temperature rises to a certain level, the body will start to sweat. When this liquid sweat evaporates, the physical conversion of the liquid to its corresponding gas form (i.e., the drying) draws heat from the nearest heat source. In the case of sweat, the nearest heat source is the skin. In this manner, sweating cools a person due to the evaporative cooling action as the sweat dries. This evaporation of sweat is dependent upon various factors, including, for example, the water vapor pressure (or relative humidity) of the air in contact with the skin. Air movement also is an important factor. For example, ambient air gains humidity as it picks up moisture during evaporation of sweat. In the absence of adequate air movement (ventilation), this humidified air becomes trapped in areas surrounding the skin, thus inhibiting the cooling potentially available through the continued evaporation of sweat.

Failure to properly release and move heat away from the body during exercise or physical exertion in a warm environment can cause a dangerous rise in a person's body temperature, potentially resulting in adverse health consequences, such as heat exhaustion or heat stroke.

Various known garment features are available and used to assist athletes in coping with excess heat generated as a result of physical exertion. For example, mesh venting has been used in garments to help dissipate heat. In sports apparel, it is common to see underarm vents provided by very small or closed-hole meshes, or by small eyelets provided through the fabric. While helpful, such meshes or vents typically are too small or too impermeable to provide adequate cooling effects.

Adequate cooling is not the only body temperature control issue that athletes and others face. The human body also may suffer adverse effects when exposed to cool or cold environmental conditions, particularly when exposed to such conditions for lengthy time periods. While people can simply add another layer of clothing to help stave off the adverse effects of a cold environment in some situations, the addition of clothing layers can adversely impact the wearer's ability to move, particularly when engaged in exercise, athletic events, or other activities requiring movement. The additional weight, bulk, and/or wind resistance resulting from the additional clothing also can adversely impact athletic performance. The adverse impacts on performance and comfort may deter some users from adequately dressing to protect themselves from the cold.

SUMMARY

Some example aspects of the present invention relate to fabrics and/or garments that have "dimensionalized" or three dimensional fabric structures. As more specific examples, fabrics according to at least some examples of this invention include: (a) a fabric material forming a fabric base level (e.g., corresponding to the fabric's major surface(s)); and (b) a plurality of self-standing fabric surface modifying elements integrally formed in the fabric material (e.g., by molding, embossing, etc.), wherein at least some of the fabric surface modifying elements define a fabric contact level different from the fabric base level. The fabric surface modifying elements may be formed throughout the fabric structure, or alternatively, they may be formed in one or more discrete portions or regions of the fabric structure. Garments according to at least some examples of this invention may include, for example, a first fabric element formed from a fabric material including fabric surface modifying elements of the types described above. The fabric material and/or the locations of the surface modifying elements in the garment structure may be selected, if desired, to promote better evaporative cooling of the body, such as by providing dimensionalized mesh or other highly permeable fabric along the wearer's spine, along the wearer's sides, and/or at other locations of the body that release substantial heat, e.g., during exercise, exertion, etc. Alternatively, the fabric material and/or the locations of the surface modifying elements in the garment structure may be selected, if desired, to provide improved thermal insulative properties (e.g., air pockets) at desired locations along the wearer's body, e.g., to better hold in heat generated by the wearer's body and resist transfer of cold from the outside. The overall garment structure may be made from multiple pieces of fabric joined together, and any number of these multiple pieces (including all of the pieces) may include fabric having surface modifying elements.

Additional example aspects of this invention relate to methods for forming fabrics and/or garments including "dimensionalized" materials, e.g., fabrics and garments having surface modifying elements, e.g., of the types described above. Methods of producing fabrics according to at least some examples of this invention may include: (a) providing a fabric material (e.g., making the fabric, obtaining it from a commercial vendor, etc.); and (b) forming a plurality of self-standing fabric surface modifying elements in the fabric material, wherein at least some of the fabric surface modifying elements define a fabric contact level that differs from a base level of the fabric material. Any desired manner of forming the fabric surface modifying elements in the fabric may be used without departing from the invention, such as via molding, rolling, embossing, and/or calendering procedures; through stretching or crimping procedures; by applying heat and/or pressure; etc. Example methods of forming garments in accordance with at least some example aspects of this invention may include: (a) providing and/or forming a fabric element including a "dimensionalized" fabric material, e.g., fabrics having surface modifying elements of the types described above; and (b) forming a garment structure including the fabric material (e.g., by sewing and/or other conventional techniques). The fabric surface modifying elements may be formed in the fabric material at any time in the process, e.g., before or after garment formation, as one of the garment formation steps, etc. Any combination of mesh, non-mesh, and/or "dimensionalized" mesh fabrics may be used in an individual garment structure without departing from this invention. Also, the garments may be formed in such a manner so as to provide the fabric surface modifying elements at one or more desired or targeted locations or zones in the garment structure (e.g., along the user's spine and/or sides; at locations that release substantial body heat; etc.).

BRIEF DESCRIPTION OF THE DRAWINGS

Various objects, features, and advantages of the present invention will be more readily apparent and more fully understood from the following detailed description, taken in conjunction with the appended drawings, in which.

DETAILED DESCRIPTION

Figure 1:
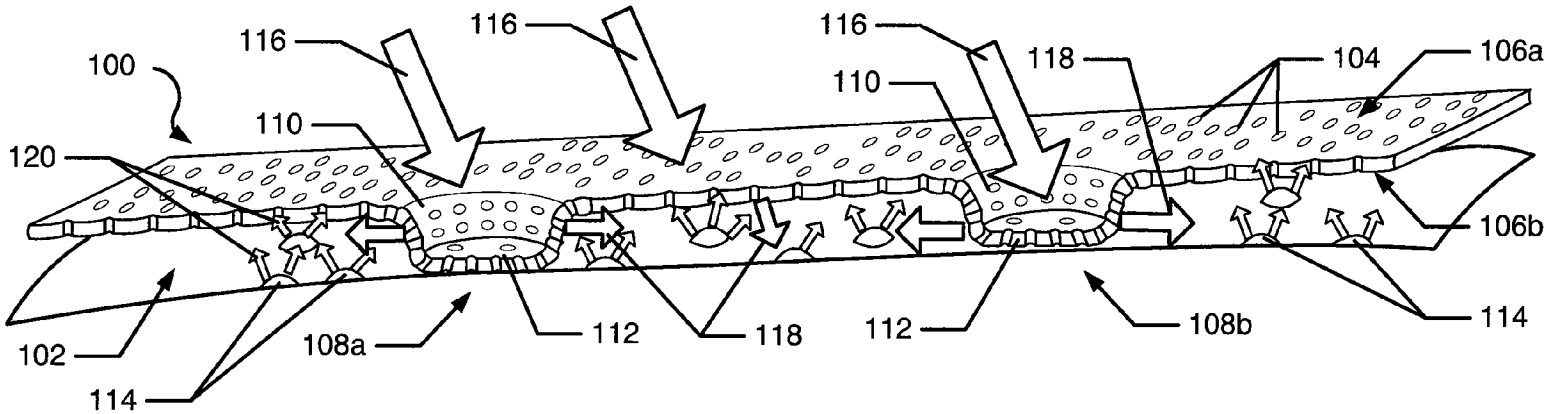
FIG. 1 illustrates an example "dimensionalized" fabric material according to the invention, including an example evaporative cooling mechanism.

Various specific examples of the invention are described in detail below in conjunction with the attached drawings.

I. General Description of Aspects of the Invention

A. Fabrics and Garments in Accordance with Example Aspects of this Invention In general, at least some example aspects of this invention relate to fabrics and garments that have "dimensionalized" structures. Fabrics according to at least some examples of this invention include: (a) a fabric material that defines or forms a fabric base level; and (b) a plurality of self-standing fabric surface modifying elements integrally formed in the fabric material, wherein at least some of the fabric surface modifying elements define a fabric contact level different from the fabric base level. In at least some more specific examples of this invention, the fabric material may define a first major surface and a second major surface opposite the first major surface, and the plurality of self-standing fabric surface modifying elements may include at least first and second self-standing fabric surface modifying elements that extend in a direction from the fabric material's first major surface toward its second major surface, and at least some portions of the fabric material forming the fabric surface modifying elements may extend beyond the second major surface. While the "dimensionalizing" structure may be formed throughout the fabric material structure, alternatively, if desired, it may be formed in one or more discrete portions of the fabric material structure without departing from this invention.

Garments according to at least some examples of this invention may include, for example, a first fabric element formed from a fabric material. This fabric material may include a fabric base level and a plurality of self-standing fabric surface modifying elements integrally formed in the fabric material. At least some of the fabric surface modifying elements may define a fabric contact level different from the fabric base level. Still other garments according to examples of this invention may include fabric having at least first and second self-standing fabric surface modifying elements of the types described above. The fabric including the surface modifying elements may be selected and/or positioned at various locations in the garment structure (e.g., at specially targeted regions or zones), e.g., to promote better cooling of the body, such as along the wearer's spine, along the wearer's sides, etc.; to provide thermal insulative air pockets to better retain heat near the wearer's body and prevent cold transfer from the external environment; etc. The overall garment structure may be made from multiple pieces of fabric joined together. If desired, the fabric material including the surface modifying elements may be joined to other fabric materials that include additional surface modifying elements, or it may be joined with fabric materials not including surface modifying elements without departing from the invention. An individual garment structure may contain any desired number of different pieces of fabric, and optionally any desired number of pieces of fabric material including surface modifying elements formed therein, without departing from this invention.

The surface modifying elements may take on a wide variety of different forms without departing from this invention. For example, the surface modifying elements may be made in any desired size or shape and/or placed in any desired regular, repeating, and/or symmetrical pattern, or placed in a random, non-discernible or overlapping pattern or manner, without departing from this invention. Also, a single garment may have surface modifying elements in a variety of different shapes, sizes, and/or patterns without departing from this invention.

In at least some examples of this invention, at least some of the fabric surface modifying elements may be formed to include at least one wall member extending from the fabric base level toward the fabric contact level (e.g., a wall extending away from the main surface of the fabric, optionally transverse or substantially transverse to the main surface of the fabric, etc.). The fabric surface modifying elements further may include a base wall member extending from the wall member, and this base wall member may at least partially define the fabric contact level (e.g., it may at least partially extend parallel to or substantially parallel to the main surface of the fabric). The base wall member may be substantially smooth or it also may define multiple levels (e.g., by providing an annular base portion that at least partially defines the fabric contact level and a central portion located at a position other than the fabric contact level (e.g., a "raised center"

portion)). When formed from a mesh fabric material, the fabric surface modifying elements may be sized, shaped, and arranged such that the wall member and/or the base wall member include at least portions of plural mesh openings of the mesh fabric material.

Fabric surface modifying elements of the types described above may perform a variety of functions. For example, when used in a garment structure for warm or hot environments, the fabric material may be selected to be relatively gas permeable (e.g., mesh or other highly gas permeable fabrics), and the surface modifying elements may help prevent undesired cling to the body (e.g., due to sweat, rain, damp or humid conditions, etc.) and/or provide increased space for air circulation (e.g., as the wearer moves, from wind, etc.). When used in a garment structure for cool or cold environments, the fabric material may be selected to be somewhat less gas permeable, and the surface modifying elements may help provide thermally insulative air pockets that help hold heat near the wearer's body and prevent cold transfer from the external environment. Even when formed for use in cool or cold environments, the fabric material may contain some degree of gas permeability, e.g., sufficient to wick away moisture and provide some breathability, to provide a comfortable fit, etc.

The fabric surface modifying elements may be self-standing, as described above, and they may be integrally formed in the fabric without additional or separate supporting members (e.g., by forming the fabric surface modifying elements in a mold or using a calender, by embossing procedures, by application of heat and/or pressure (akin to forming a crease or pleat in fabrics, e.g., by ironing or pressing techniques, etc.), etc.). In this manner, the fabric surface modifying elements may remain flexible and/or deformable from their original shape (e.g., under an applied force), for example, they may flatten out, compress, fold, collapse, or stretch under an applied force or load. Once deformed, however, fabric surface modifying elements in accordance with at least some examples of this invention will tend to return toward their original shape, e.g., when the applied force or load is removed or reduced in intensity.

The type or characteristics of the fabric, the temperature during molding or embossing, the time of fabric contact with the heated molding or embossing equipment (also called "dwell time"), as well as other processing parameters may be important factors in producing a final fabric or garment structure. For example, if the temperature is too high or the dwell time too long, the fabric may burn, harden (e.g., due to excessive fiber melting, clumping, etc.), or otherwise obtain undesirable characteristics. On the other hand, if the temperature is too low or the dwell time too short, the resulting three dimensional "structure" may not be well formed or well set in the fabric structure (which may cause the fabric to quickly lose its structure, e.g., during routine use, laundering, etc.). Those skilled in the art will be capable of determining appropriate dwell times, temperatures, and/or other embossing or molding conditions for a given fabric material through the use of routine experimentation.

B. Methods of Making Fabrics and Garments in Accordance with Example Aspects of this Invention Additional example aspects of this invention relate to methods for forming fabrics and garments including "dimensionalized" structures, e.g., fabrics and garments including fabric surface modifying elements of the types described above. Methods of producing fabrics according to at least some examples of this invention may include: (a) providing a fabric material (e.g., making the fabric, obtaining it from a commercial vendor, etc.); and (b) forming a plurality of self-standing fabric surface modifying elements in the fabric material, wherein at least some of the fabric surface modifying elements form or define a fabric contact level that differs from a base level of the fabric material. Any desired manner of forming the fabric surface modifying elements in the fabric may be used without departing from the invention. For example, the fabric surface modifying elements may be formed in a mold, using rollers or a calender device, by embossing, through stretching or crimping methods, and the like. If desired, heat and/or pressure may be applied to the fabric material, optionally in combination with one or more of the various techniques described above, to form the self-standings fabric surface modifying elements (akin to forming creases or pleats in fabric). While the "dimensionalizing" structure may be formed throughout the fabric structure, if desired, it also may be formed in one or more discrete portions of the fabric structure without departing from this invention.

Still additional aspects of this invention relate to methods for forming garments that include a "dimensionalized" material (e.g., mesh or other materials with surface modifying elements of the various types described above). Such methods may include providing a first fabric element of a fabric material. The fabric material may be formed so as to integrally include a plurality of self-standing fabric surface modifying elements, wherein at least some of the fabric surface modifying elements form or define a fabric contact level that differs from a base level of the fabric material. This fabric element is formed as at least part of a garment structure. The fabric surface modifying elements may be formed in the fabric material at any time in the process, e.g., before, during, or after garment formation.

The fabric material may be provided for use in the garment forming process, if desired, by forming the fabric to include surface modifying elements, e.g., in the manner(s) described above. Alternatively, if desired, one could obtain fabric including self-standing fabric surface modifying elements formed therein from another source (e.g., produced by a vendor, etc.). The garment structure "forming" step may be accomplished in various different manners without departing from the invention, including by conventional garment forming techniques known and used in the art. For example, the garment may be produced by sewing multiple pieces of fabric together, wherein one or more of the various fabric pieces include a "dimensionalized" structure. Any combination of "dimensionalized" and "non-dimensionalized" fabrics may be used in an individual garment structure without departing from this invention. Also, the garments may be formed in such a manner so as to provide the fabric surface modifying elements at one or more desired or targeted locations in the garment structure (e.g., along the user's spine, sides, etc.).

In the same manner as described above, the surface modifying elements may be provided and/or formed in many desired forms without departing from this invention. For example, the surface modifying elements may be provided and/or formed in any desired size or shape; in any desired regular, repeating, and/or symmetrical pattern; and/or in random, non-discernible, and/or overlapping patterns or manners, without departing from this invention. Also, a single garment structure may formed so as to include surface modifying elements in a variety of different shapes, sizes, and/or patterns without departing from this invention.

Specific examples of the invention are described in more detail below. The reader should understand that these specific examples are set forth merely to illustrate examples of the invention, and they should not be construed as limiting the invention.

II. Specific Examples of the Invention

The figures in this application illustrate various examples of fabrics and/or garment structures in accordance with this invention. When the same reference number appears in more than one drawing, that reference number is used consistently in this specification and the drawings to refer to the same part or element throughout.

Figure 2A:
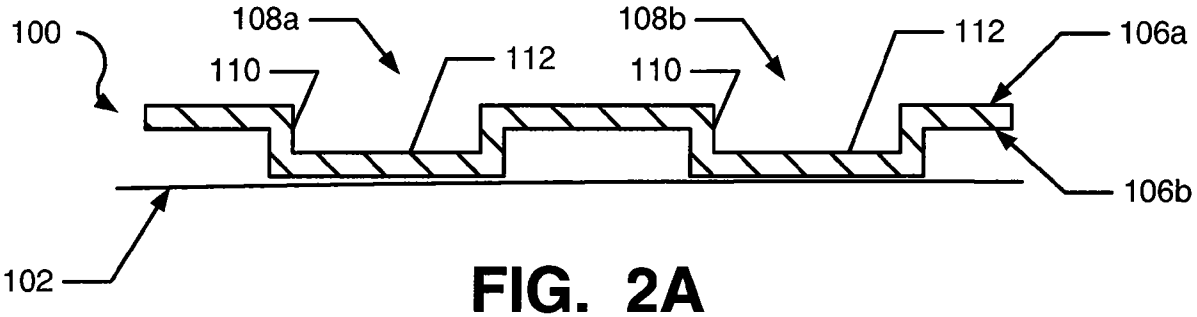
FIGS. 2A and 2B illustrate sectional and overhead views of an example "dimensionalized" fabric material according to the invention.
Figure 2B:
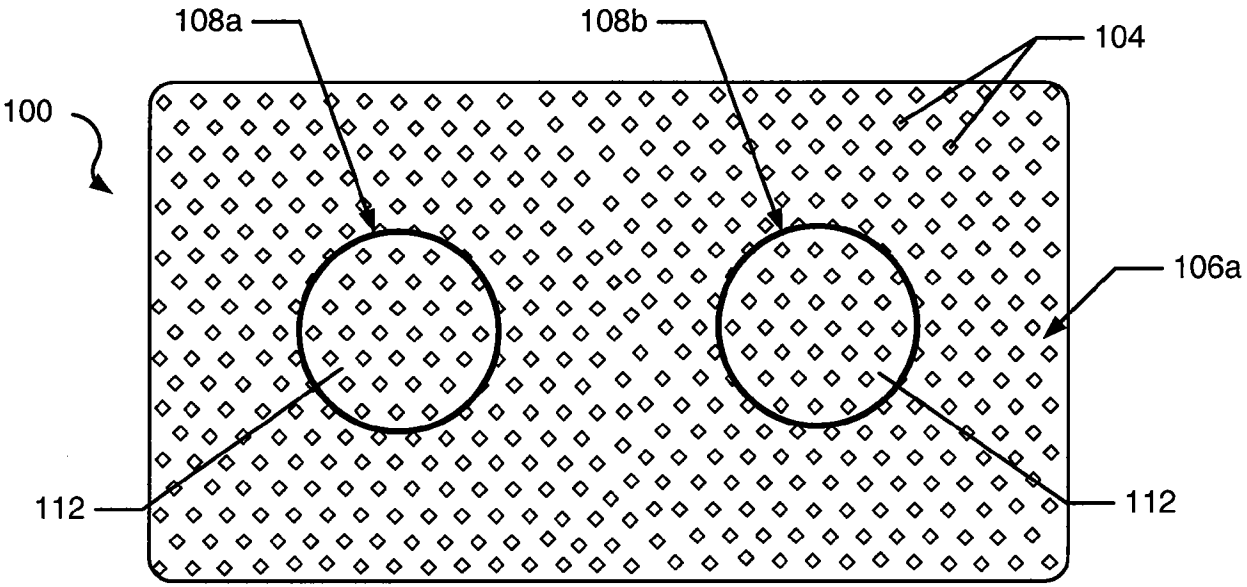

FIGS. 1, 2A, and 2B illustrate example fabric materials 100 according to at least some examples of this invention in which the fabric material 100 is a mesh material and is included as part of an overall garment structure. In this illustrated example, the fabric material 100 is being worn by a user (reference number 102 represents the wearer's skin surface). As shown, the mesh fabric material 100 includes a plurality of mesh openings 104, formed in a regular and repeating pattern throughout the mesh fabric material 100. While any size and/or shape mesh openings 104 may be used without departing from this invention, in at least some examples of this invention, the mesh openings 104 will be generally elliptical, circular, square, rectangular, or rounded square or rectangular in shape, having an overall length and/or width dimension, for example, of at least 0.1 mm, and in some examples, at least 0.5 mm, or even at least 1 mm. The mesh openings 104 may be formed in the fabric material 100 at any desired time and/or in any desired manner without departing from this invention, including at conventional times and/or in conventional manners known and used in the art. Notably, the fabric material 100 includes an upper major surface 106*a* and a lower major surface 106*b*, either of which may be considered a fabric base surface and/or as defining a fabric base surface layer or level.

FIGS. 1, 2A, and 2B further illustrate that the fabric material 100 includes two separate and distinct, self-standing, surface level modifying elements 108*a* and 108*b*. Of course, any number of surface level modifying elements may be provided in an individual piece of fabric material 100 (e.g., in a repeating pattern, etc.) without departing from this invention. The surface level modifying elements 108*a* and 108*b* may be produced in any desired manner without departing from this invention (various example methods were described above and are described in more detail below). The surface level modifying elements 108*a* and 108*b* may be produced in any desired size and/or shape, and in any desired pattern or arrangement (including in random patterns or arrangements) without departing from this invention. Moreover, if desired, different sizes, shapes, patterns, and/or arrangements of surface level modifying elements 108*a* and 108*b* may be included in a single piece of fabric material 100 without departing from this invention. As some more specific examples, if desired, the individual surface level modifying elements 108*a* and 108*b* may have an overall length or width dimension (e.g., diameter) of at least 6 mm, and in at least some examples, this dimension may be at least 10 mm or at least 15 mm.

Also, the surface level modifying elements may be separated from one another by any desired distance without departing from this invention, e.g., depending on the size, shape, and/or dimensions of the individual surface level modifying elements, desired aesthetics, anticipated use, etc. As some more specific examples, if desired, the center-to-center distance between surface level modifying elements may be at least 15 mm, or even at least 20 mm or 25 mm, without departing from this invention. Also, if desired, the center-to-center distance may be different in one dimension of the fabric as compared to another dimension. The center-to-center distances and/or directions also may change and vary within an individual piece of fabric.

The surface level modifying elements 108*a* and 108*b* of this example structure 100 include at least one wall member 110 extending from the fabric base surface level (e.g., in a generally transverse direction away from the base surface level) and a base wall 112 generally located below the level of the fabric base surface level. The base wall 112, if desired, may extend generally parallel to the fabric base surface level. Alternatively, if desired, the base wall 112 itself may form or define multiple different levels, such as by providing a raised central portion, as will be described in more detail below. Notably, as illustrated in FIGS. 1 and 2B, the side wall members 110 and/or the base wall members 112 may be sized, shaped, and arranged such that they include multiple mesh openings 104 when the fabric material 100 is a mesh fabric.

Through structures of the types described above, the surface level modifying elements 108*a* and 108*b* establish or define a fabric contact surface or level located below the base surface level of the fabric material 100. This contact surface or level may be used to help hold at least some portions of the fabric material 100 (e.g., the majority of the fabric material 100) up and off the wearer's body 102, thereby reducing "cling" of the fabric material 100 to the wearer's body, improving air flow around and against the wearer's body, and improving or maximizing evaporative cooling. Alternatively, in some examples, this contact surface or level may be used to provide a thermally insulative partial layer of heated air within the fabric or garment structure, to help keep the wearer warm in cold environments.

FIG. 1 further illustrates a potential evaporative cooling mechanism that may be available when wearing fabric materials 100 that are relatively gas permeable and include surface level modifying elements, e.g., elements 108*a* and 108*b*, according to examples of the invention. As shown, as the wearer wears the garment including the mesh or other gas permeable fabric material 100, the surface level modifying elements 108*a* and 108*b* help raise at least some portions of the major surface 106*b* of the fabric material 100 up and off the wearer's body 102. The fabric material 100, however, may remain relatively soft and flexible, e.g., such that in some instances and/or at least at some times, the major surface 106*b* of the fabric material 100 may contact the wearer's body 102 in areas between surface level modifying elements. As the wearer's body heats up (e.g., as a result of physical exercise, exertion, etc.), the wearer may begin to sweat, as illustrated by beads of sweat 114 on the body 102 in FIG. 1.

Through wearer movement, wind, and/or ambient air movement, air currents 116 will contact the exterior surface 106*a* of the mesh fabric material 100. The mesh openings 104 in the fabric material 100, other openings, and/or the general permeability of the fabric material 100, will allow at least some portion of the air currents 116 to pass to the interior of the garment, as illustrated by the arrows identified by reference number 118 in FIG. 1 (e.g., air is channeled into the "micro-environment" of the fabric 100 interior, between and around the fabric surface modifying elements 108*a* and 108*b*). As described above, the fabric surface modifying elements 108*a* and 108*b* help hold at least some portions of the fabric base surface 106*b* up and off the wearer's body 102, which provides more room for air circulation. This improved air circulation or movement within the garment's interior helps the sweat beads 114 evaporate more readily (as represented by reference number 120), which helps pull heat from and cool the wearer's body (e.g., by the evaporative cooling processes described above). The evaporated water vapor also can easily move away from the wearer's body 102 and be released from the garment interior, e.g., via the mesh openings 104, via other openings, and/or by permeating through fabric material 100.

Figure 3A:
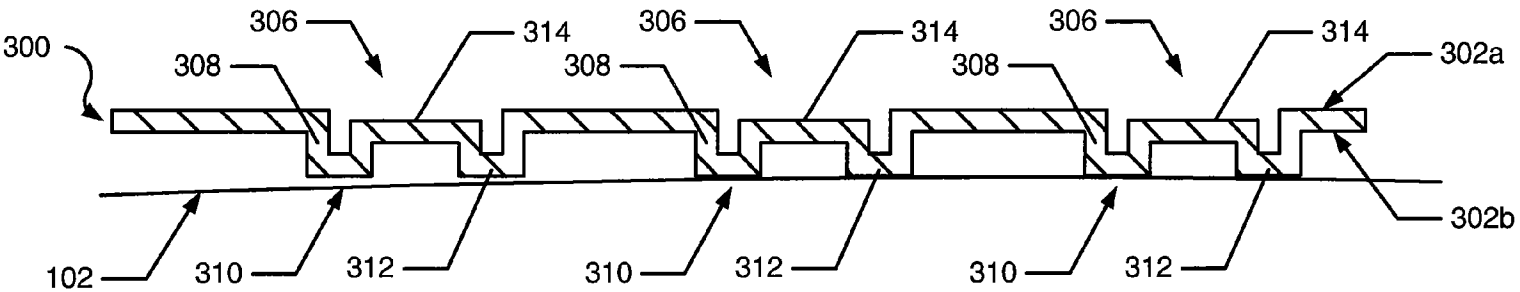
FIGS. 3A and 3B illustrate sectional and overhead views of another example "dimensionalized" fabric material according to the invention.
Figure 3B:
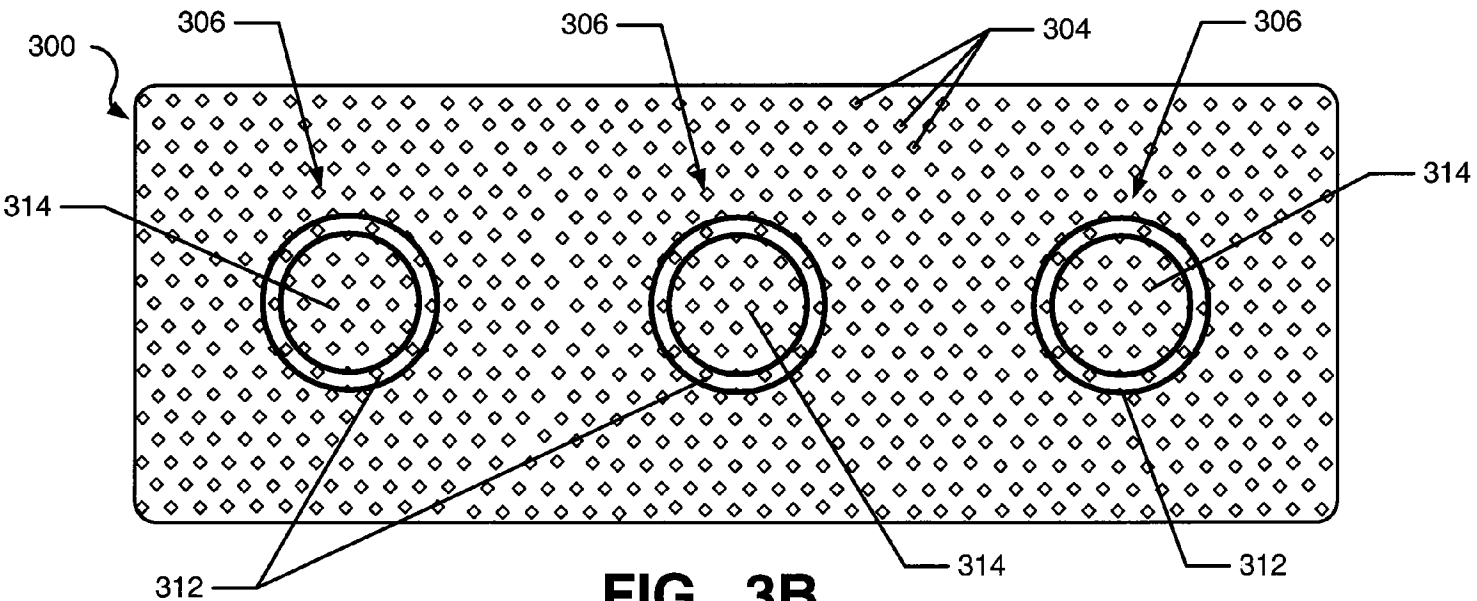

FIGS. 3A and 3B illustrate another example fabric material 300 having an upper major surface 302*a*, a lower major surface 302*b*, and, in this example, multiple mesh openings 304. The upper and/or lower major surfaces 302*a* and 302*b* define a fabric material base level. The fabric material 300 of this example includes plural fabric surface modifying elements 306 that extend away from the fabric base level and define a fabric contact level, e.g., at or near the wearer's skin 102. The fabric surface modifying elements 306 of this example fabric 300 differ from those described above in conjunction with FIGS. 1, 2A, and 2B. In this example fabric material 300, the fabric surface modifying elements 306 include one or more side wall members 308 (e.g., a wall member generally transverse to the base level) extending from the fabric material base level, and a base wall member 310 extending from the wall member(s) 308. The base wall member 310 in this example fabric material 300, however, has multiple levels. Any way of providing multiple levels in the base wall member 310 may be used without departing from this invention. In this illustrated example, the base wall member 310 includes an annular ring area 312 defining the fabric contact level or surface and a raised central portion 314 located somewhat above the annular ring area 312 and back toward the fabric base level.

The fabric structure 300, including fabric surface modifying elements 306 having raised central portions 314, has added advantageous properties in that a very low percentage of the fabric material 300 may directly contact the wearer's skin 102, thereby providing additional room for air circulation and/or less fabric "cling" to the wearer's body 102. The raised central portions 314 also can help provide additional structural "stiffness" and more stability to the overall fabric surface modifying elements 306, making them less likely to collapse or turn inside-out and making it somewhat less likely that the fabric base surface 302*b* will bow inward and contact the wearer's skin 102 in the area between adjacent fabric surface modifying elements 306. Nonetheless, the fabric material 300 may remain relatively soft and flexible, e.g., such that in some instances and/or at least at some times, the major surface 302*b* of the fabric material 300 may contact the wearer's body 102 in areas between surface level modifying elements 306.

Of course, the fabric surface modifying elements 306 may be of any desired size, shape, and/or arrangement without departing from this invention, e.g., in the manners described above. Also, the raised central portion 314 may have any desired size, shape, and configuration without departing from the invention. Furthermore, if desired, the raised central portion 314 may be shaped differently from the general outer or exterior shape of the fabric surface modifying element 306 in which it sits (for example, if desired, the raised central portion 314 inside the circular annular ring portion 312 may be square, elliptical, star-shaped, triangular; it may include formed letters, numbers, logos, or symbols; etc.). Additionally, the raised central portion 314 may extend back toward the fabric base level to any desired degree without departing from the invention, including, if desired, beyond one or both of the major surfaces 302*a* and 302*b*. Different sizes and shapes of the various fabric surface modifying elements 306 and/or raised central portions 314 may be provided in a single piece of fabric material 300 without departing from this invention. Additionally, the exterior shape of the surface modifying element 306 may include any desired shapes, such as letters, numbers, logos, symbols, etc.

Alternatively, as described above, the structure of FIGS. 3A and 3B may be used to provide a heat insulative fabric material, e.g., when used with a fabric having a relatively low gas permeability, by providing a partial layer of thermally insulating air (and heated air from the wearer's body heat) between the fabric 300 and the wearer's body.

Figure 4:
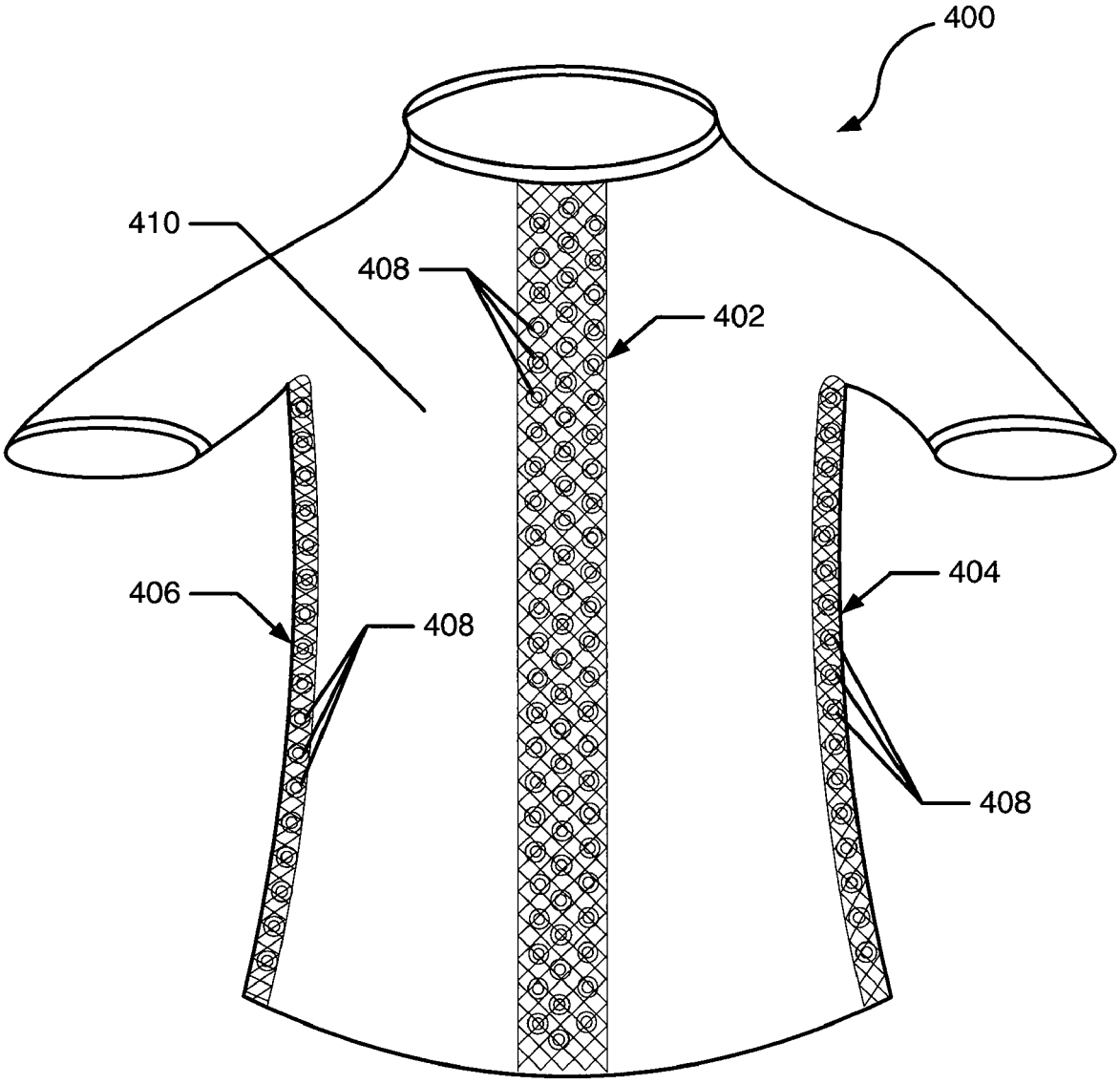
FIGS. 4 through 10 illustrate example garment structures that include "dimensionalized" fabrics in accordance with at least some examples of this invention.

FIG. 4 illustrates an example garment 400 including various panels of fabric material 402, 404, and 406 (which are mesh fabrics in this structure). "Garments" generally include any type of wearing apparel for the torso, arms, and/or legs. Examples of suitable garments that may include features or aspects of this invention include, but are not limited to: T-shirts, jerseys, tank tops, shorts, pants, sweat pants, leotards, track-suit type garments, or the like, of any desired size and/or style, optionally sleeveless, short-sleeved, long sleeved, with removable sleeves, with removable pant legs, etc.

As noted above, the garment 400 may include one or more fabric panels 402, 404, and/or 406, and these panels 402, 404, and/or 406 may include surface level modifying elements 408, as illustrated in the figure and described above. The material 410 in the areas between the illustrated panels 402, 404, and 406 may be one or more individual pieces of any desired or type of material without departing from the invention. Additionally, if desired, all or any desired parts of the garment 400 may be made of a mesh material, optionally the same material as (or similar material to) that used in panels 402, 404, and/or 406. As still another possible option, all or a large part of the garment 400 may be made a material including surface modifying elements 408 of the types shown in FIGS. 1 through 3B.

If desired, as illustrated in FIG. 4, one or more of the panels 402, 404, and 406 may be provided in desired areas of the garment structure 400 to provide "targeted" or "zoned" venting. More specifically, if desired, various "dimensionalized" fabric areas (e.g., mesh fabric areas including surface modifying elements 408) may be provided at various targeted locations in the garment structure 400 so as to help keep an athlete or other user cooler by increasing air flow or circulation over various targeted regions of the body (e.g., the center back and two sides, in this illustrated example). As described above, the human body typically releases significant amounts of its excess heat in the center back area, and increased air flow or circulation in the center back region, via the zoned venting and "dimensionalized" panel 402 as described above, improves the evaporation of sweat from the skin, and hence, improves the evaporative cooling process (as described above). Additionally, this improved air flow or circulation moves fresh, relatively cool, and less humid air into the targeted regions and moves the heated and humidified air out. Vented zones at the athlete's sides (e.g., via panels 404 and 406) help improve intake and exhaust air flow, e.g., when the body is moving forward or laterally, movement that frequently occurs during exercise and/or sporting events. When vented zones and "dimensionalized" structures are provided at least at the center back (panel 402) and lateral sides (panels 404 and 406) of the garment structure 400, air can flow into the garment 400 at the garment sides and around to the back and out, helping to evaporate sweat and move heated, humidified air away from the body.

The rise in core body temperature during exercise or exertion when wearing an example garment in accordance with at least some examples of the invention may be somewhat slowed or reduced (e.g., between about 0.2° F. to 0.5° F. lower or more) as compared to exercise under similar conditions wearing garments with other types of venting and/or as compared to exercise under similar conditions wearing unvented garments. Although this temperature decrease may be meaningless or minimal to the athlete who is merely "warm," an increase of even a few tenths of a degree can be very distressing to the athlete who is approaching his/her limit of heat tolerance.

Garments in accordance with examples of the present invention may be made from any desired material(s) without departing from the invention, including from conventional materials known and used in the art. In at least some examples of the invention, the fabric material making up the portions of the garment outside the "dimensionalized" panels (if any) may be a non-mesh material (or not processed to include mesh openings and/or containing fewer mesh openings). The garment portions other than the portions including the "dimensionalized" fabric zones, if any, may make up a majority of the garment structure and/or may cover a majority of the upper torso and/or the lower torso of the wearer.

The entire garment may be made from a single type of material (and even from a single piece of material), in at least some examples of the invention, but the material provided in at least the "dimensionalized" zones of the garment may be processed or otherwise altered in some manner to increase its air permeability, if desired. Such processing may include, for example: laser treatments (to perforate the material and/or provide a mesh structure); calendering, rolling, and/or other physical treatments to perforate the material and/or provide a mesh structure; stretching the fabric and/or weave (to increase inter-fiber distance); and the like.

Examples of suitable materials for garment structures in accordance with the invention include both natural and synthetic materials and mixtures thereof, e.g., depending on the desired degree of gas permeability, whether used in hot or cold environments, etc. More specific examples of suitable natural materials include: leathers, cotton materials, wool materials, fleece materials, silk materials, and the like. More specific examples of synthetic materials include: polyesters, vinyls, nylons, rubbers, spandex, polyester microfibers, polyester microfiber/cotton blends, polyester microfiber/cotton/spandex blends, and the like. In some more specific examples, apparel in accordance with at least some examples of this invention may be made from or include high performance sweat management materials (e.g., thin, lightweight fabrics made from or containing polyester microfibers, polyester microfiber/cotton blends, polyester microfiber/cotton/spandex blends, polyester/spandex blends, and the like), such as "Sphere Dry" polyester knit material and/or a Dri-FIT polyester material, e.g., as included in various commercial products available from NIKE, Inc., of Beaverton, Oreg. The garment material may be knitted, woven, and/or formed or constructed in any desired manner, including in conventional manners known and used in the art.

Figure 5:
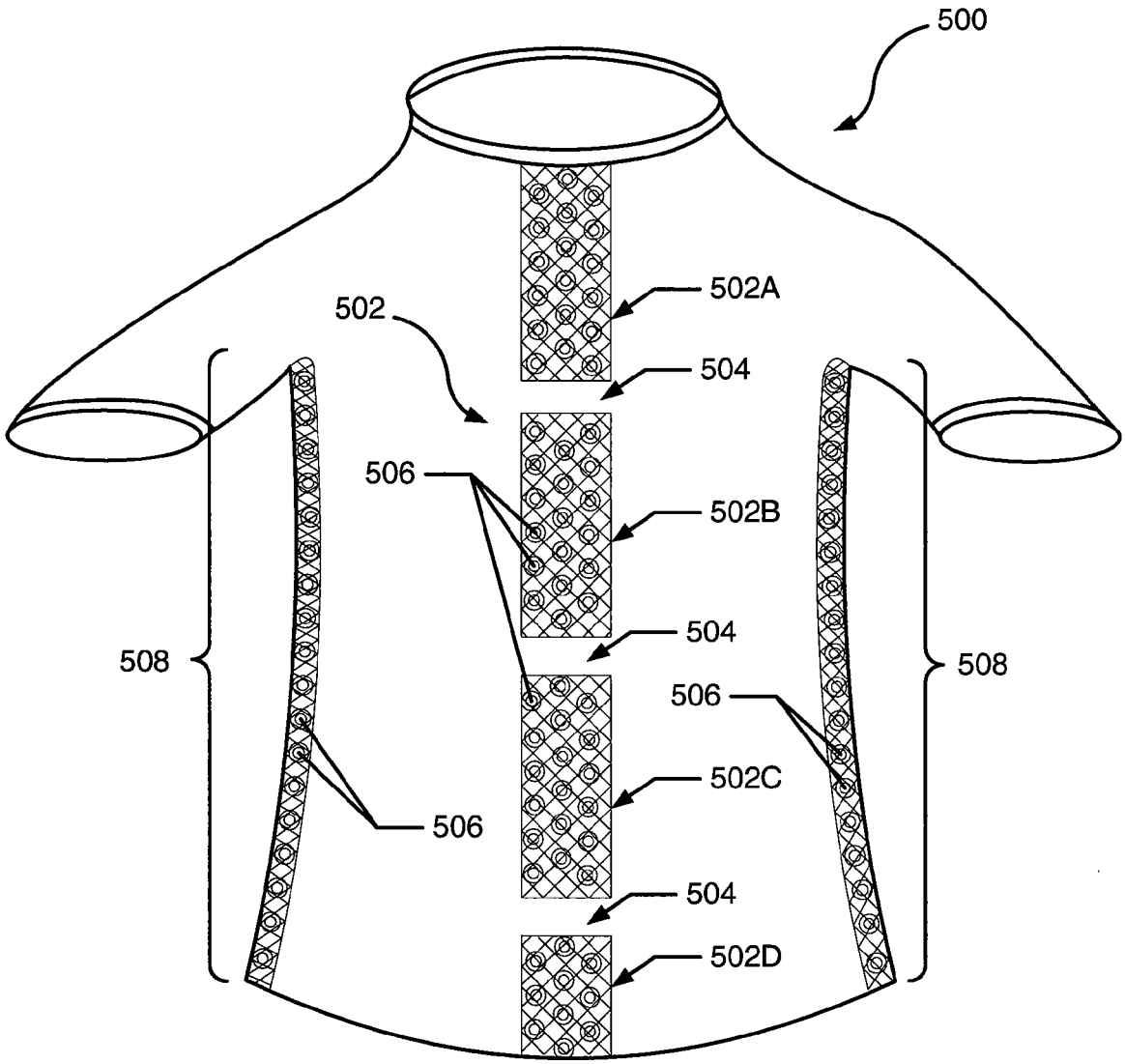

Of course, many variations in the garment structure and/or construction are possible without departing from the invention. FIG. 5 illustrates another garment structure 500 in which a targeted venting zone 502 is provided down the central spine area of the garment 500, and this targeted venting zone 502 includes several independent dimensionalized fabric zones or regions 502A, 502B, 502C, and 502D. As noted above, the area 504 between the dimensionalized zones or regions 502A, 502B, 502C, and 502D may be formed of any desired material, including mesh material (optionally a mesh material not including the dimensionalized structures or structure modifying elements 506) or a non-mesh material. In this example, the garment sides also include a mesh or other dimensionalized material 508, and optionally this side material 508 may include the dimensionalized structures or structure modifying elements 506, as shown in FIG. 5.

Figure 6:
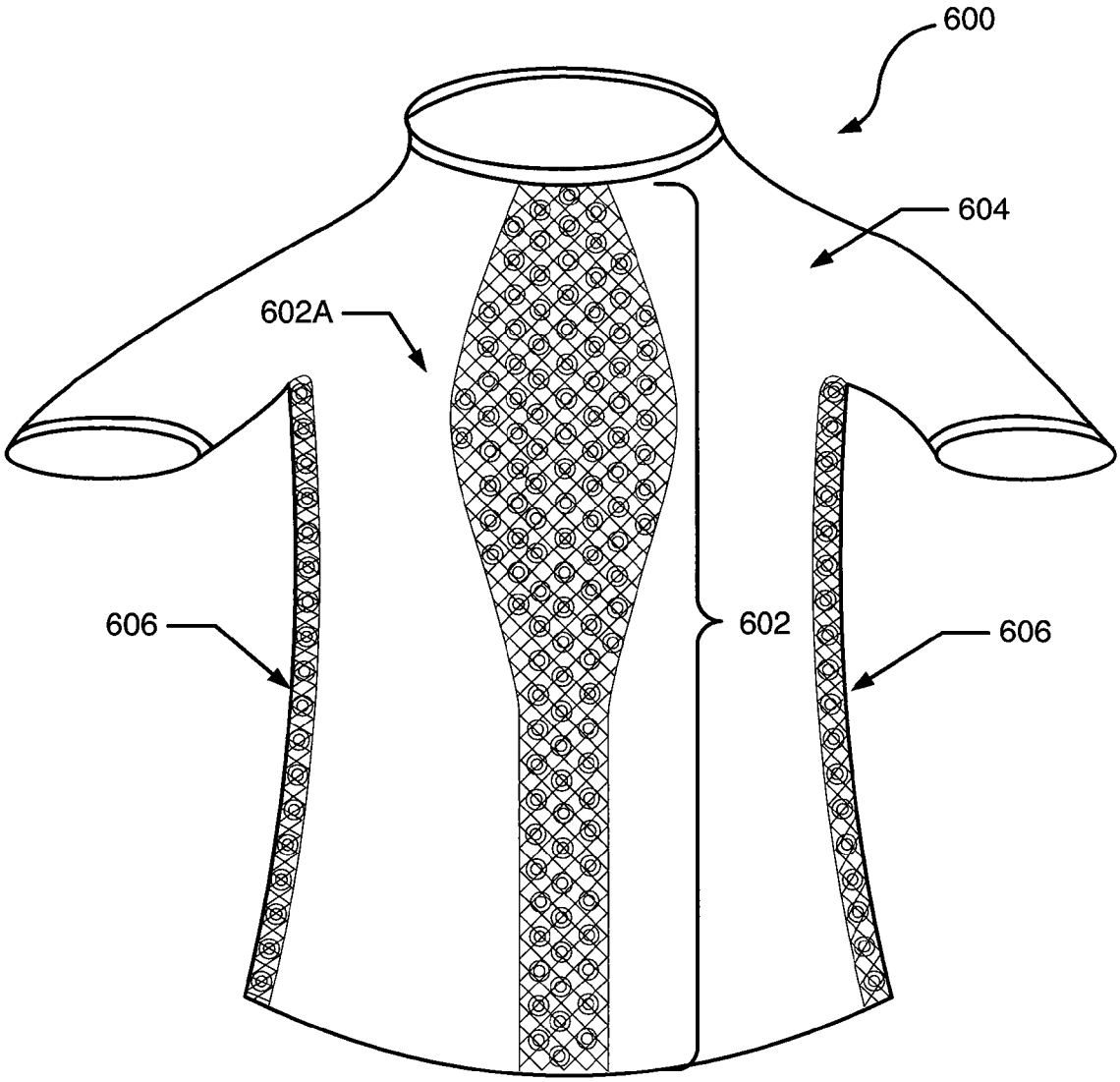

The "dimensionalized" zones or regions in a garment structure are not limited to zones or regions of any particular shapes and/or sizes. FIG. 6 illustrates another example garment structure 600 in which a dimensionalized zone 602 have an enlarged or bulged region 602A is provided along the central spine region of the garment 600. Again, any types of fabrics, constructions, and the like may be used for both the "dimensionalized" zone 602 and the portions of the garment structure 600 outside the "dimensionalized" zone 602 (e.g., regions 604) without departing from this invention. Also, any number of additional "dimensionalized" zones outside of zone 602 may be provided (e.g., zones 606 at the sides of the garment), if desired, without departing from the invention.

Figure 7B:
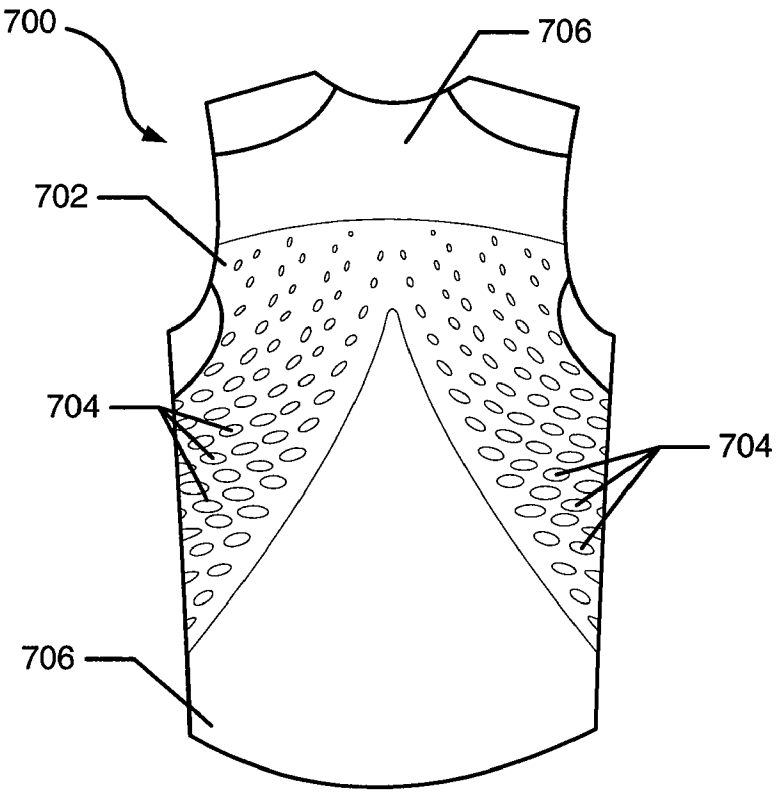
Figure 7A:
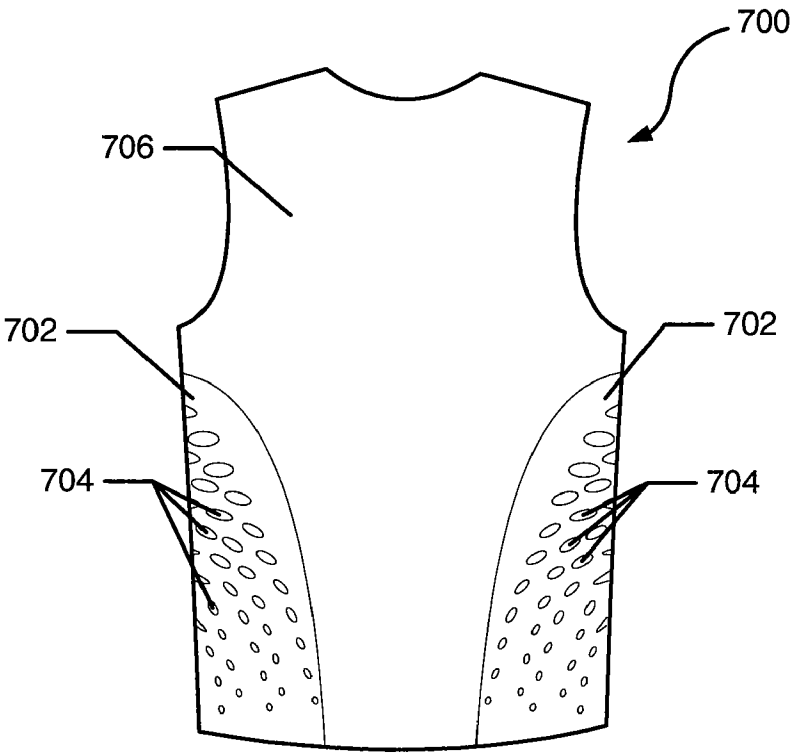

Garments other than jersey or T-shirt type garments may be provided with "dimensionalized" structures without departing from this invention. FIGS. 7A and 7B illustrate the front (FIG. 7A) and back (FIG. 7B) of a tank-top type garment 700 that includes "dimensionalized" zones 702 in accordance with examples of this invention. More specifically, in this illustrated example garment structure 700, the dimensionalized zone(s) 702 is (are) provided along the sides of the garment 700, extending from the lower front of the garment 700 to its middle/upper back region. Notably, in this example structure 700, the fabric surface modifying elements 704 are generally elliptically shaped with a gradually changing size and orientation over the extent of the garment (e.g., smaller, shallower, more vertically oriented ellipses at the zone's top and bottom edges with larger, deeper, more horizontally oriented ellipses at the zone's middle portion in the garment side area). The elliptical surface modifying elements 704 may take on any desired form without departing from the invention, including a central region having one or multiple different levels (e.g., as described in conjunction with FIGS. 1 through 3B). Any desired type of material, including a mesh material, may make up the areas 706 of the garment structure 700 around or between the "dimensionalized" zones or regions 702. Alternatively, if desired, the entire garment 700 may be made from "dimensionalized" material, optionally a mesh material, without departing from this invention.

Of course, any change or pattern of change in surface modifying element size, shape, depth, height, or orientation features may take place in a given fabric or garment structure without departing from this invention.

Figure 8:
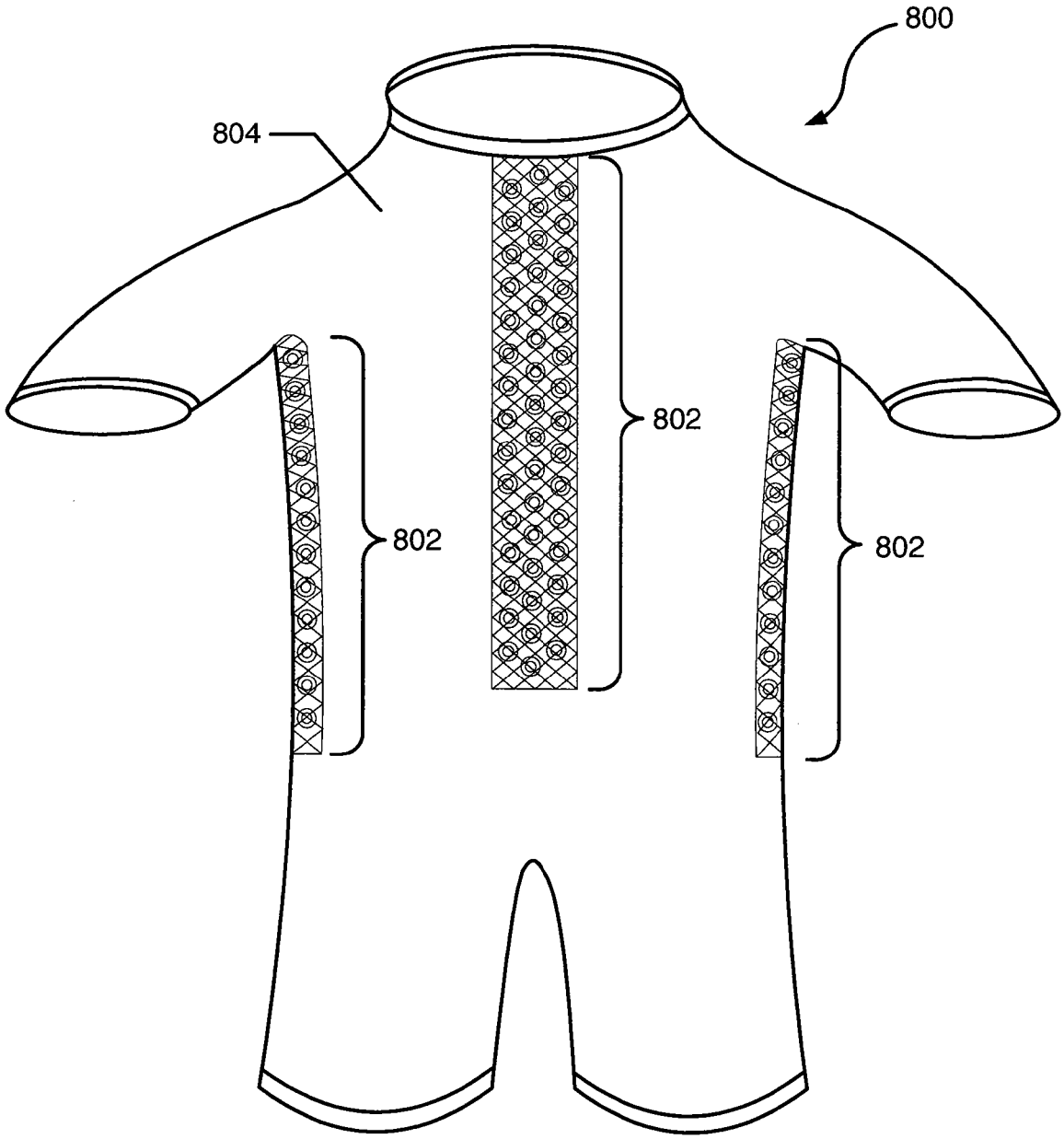
Figure 9:
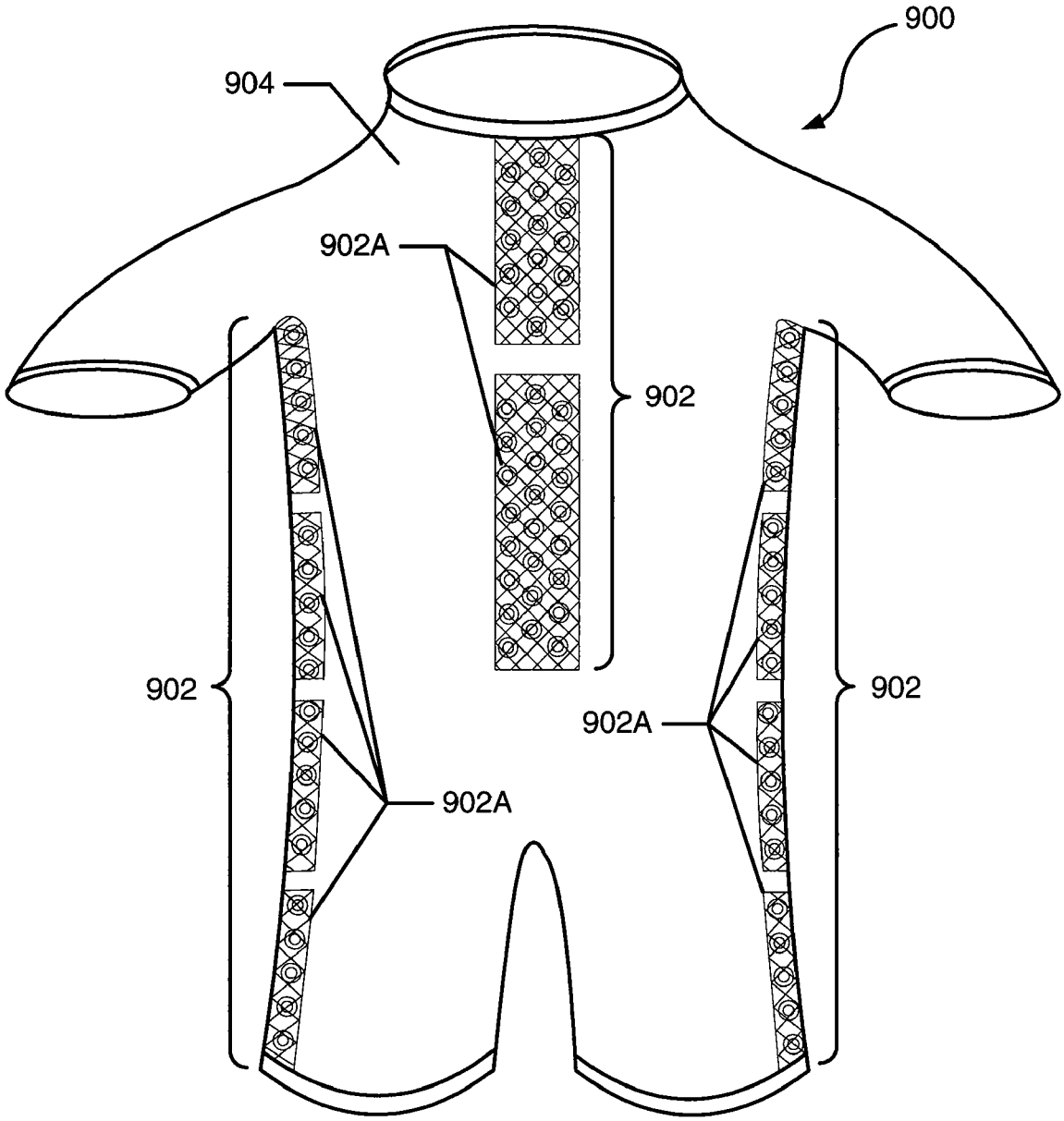

FIG. 8 illustrates an example leotard or track suit type garment 800 in accordance with examples of this invention that includes one or more "dimensionalized" zones or regions 802 (e.g., along the sides and center spine region(s)). FIG. 9 shows a similar leotard or track suit type garment 900 in which the "dimensionalized" zones 902 are divided into several plural discrete regions 902A. Any type(s) of material, including mesh or other materials the same as or different from the material(s) of zones 802 and/or 902, may make up the areas or regions 804 and/or 904 between or around the "dimensionalized" zones or regions 802 and/or 902A. Alternatively, if desired, the entire garment structures 800 and/or 900 may be made from "dimensionalized" mesh or other material(s) without departing from this invention.

Figure 10:
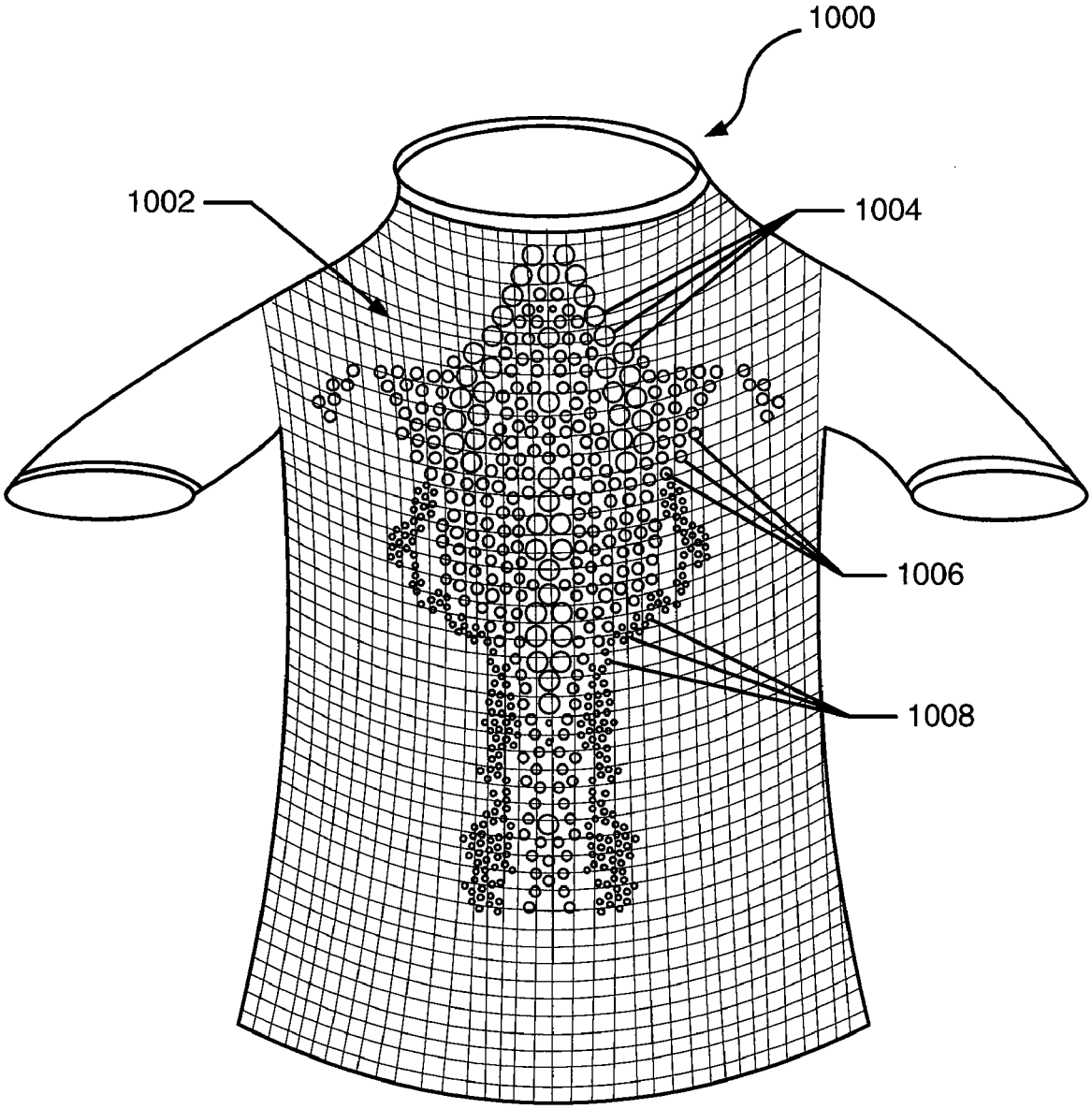

FIG. 10 illustrates another example jersey type garment 1000 in accordance with at least some examples of this invention. In this example structure, the position, shape, and/or other characteristics of the "dimensionalized" zone 1002 in the garment 1000 were determined based on a thermal profile of an athlete's body during exercise or an athletic performance (e.g., in the manner described in U.S. patent application Ser. No. 11/059,357 filed Feb. 17, 2005 (entitled "Article of Apparel Utilizing Targeted Venting or Heat Retention Zones that may be Defined Based on Thermal Profiles")). In this instance, the "dimensionalized" zone 1002 is provided along the central back or spine portion of the garment 1000. If desired, the thermal profile may be taken of a specific athlete or directed to a specific body type or size (e.g., based on the characteristics of the person who will be wearing the garment) such that the garment's dimensionalized zone 1002 characteristics are customized (e.g., located, with selected surface modifying element sizes and/or shapes, etc.) for a specific athlete or body type. Of course, "dimensionalized" patterns and arrangements for garments for other regions or parts of the body (e.g., pants, etc.) may be produced at least in part using thermal profiling as described above without departing from this invention.

The example garment structure 1000 of FIG. 10 illustrates some additional optional characteristics that may be present in at least some garment structures in accordance with this invention. For example, as shown, the individual surface modifying elements in a garment structure in accordance with the invention need not all be made the same size (e.g., surface modifying elements 1004, 1006, and 1008), and they need not form any regular pattern in the garment structure 1000. Additionally, in this example structure 1000, the individual surface modifying elements 1004, 1006, and 1008 are positioned relatively close together, to thereby help maintain the garment structure 1000 up and off the wearer's body, to help eliminate or reduce cling, to help increase or maximize air circulation and flow, and/or to help increase or maximize evaporative cooling effects. Also, in this illustrated example structure 1000, all or substantially all of the garment is formed from a mesh material.

Figure 11:
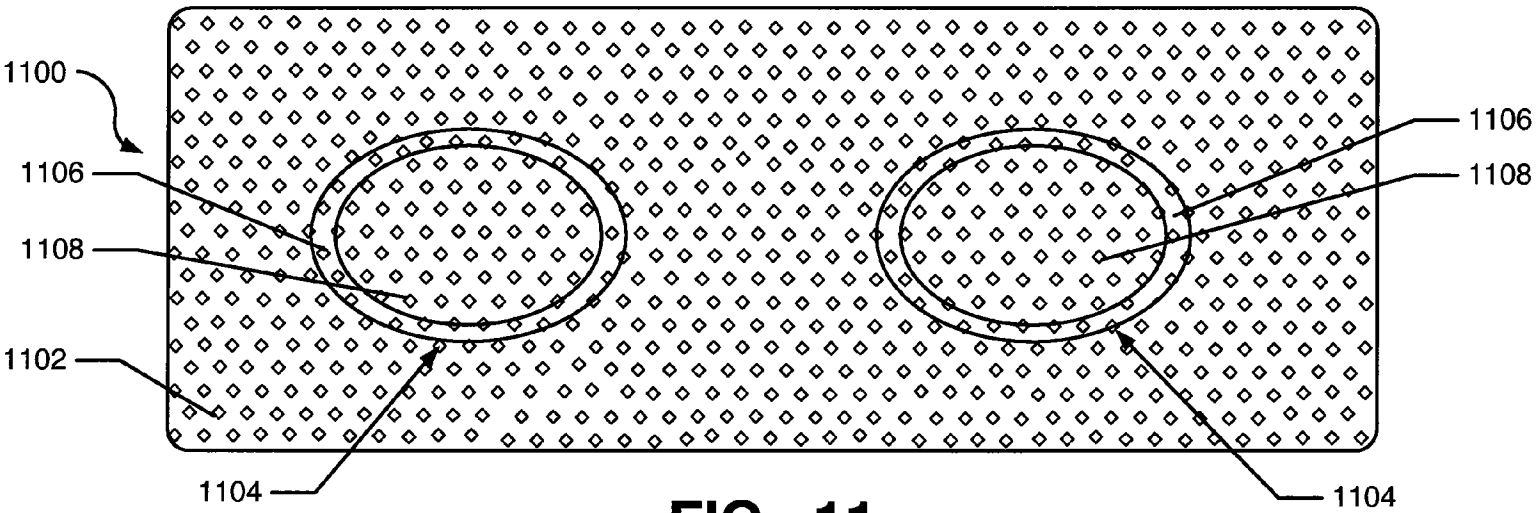
FIGS. 11-13 and 16 illustrate various examples of potential variations of fabric surface modifying elements in accordance with examples of this invention.
Figure 12:
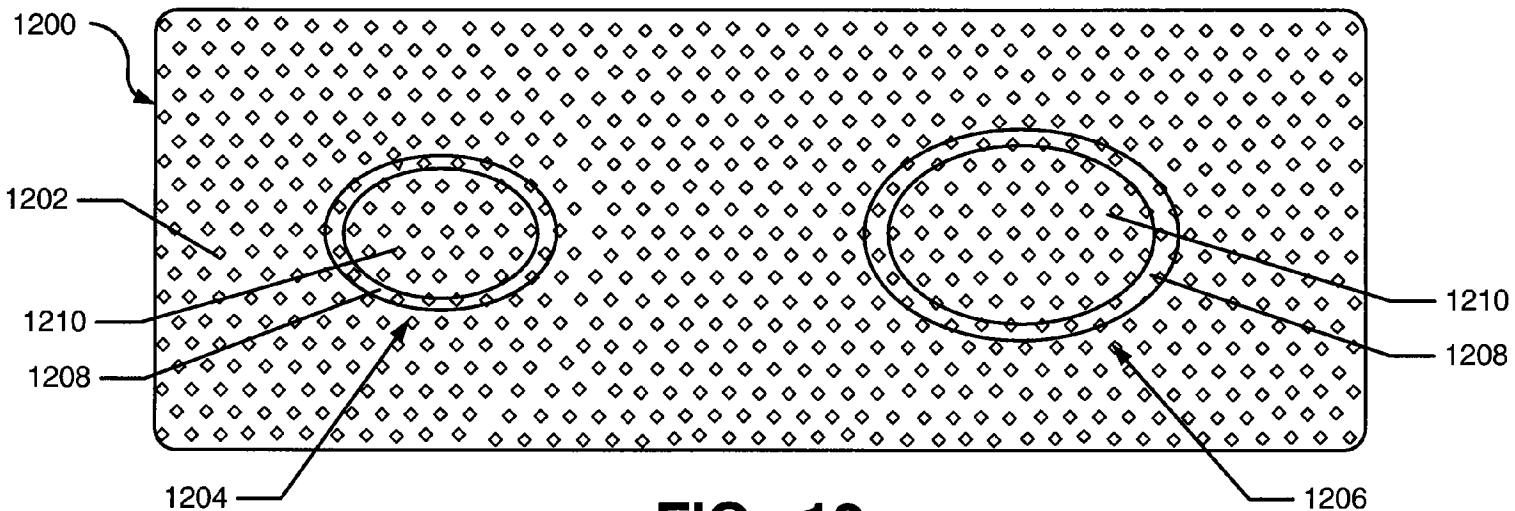
Figure 13:
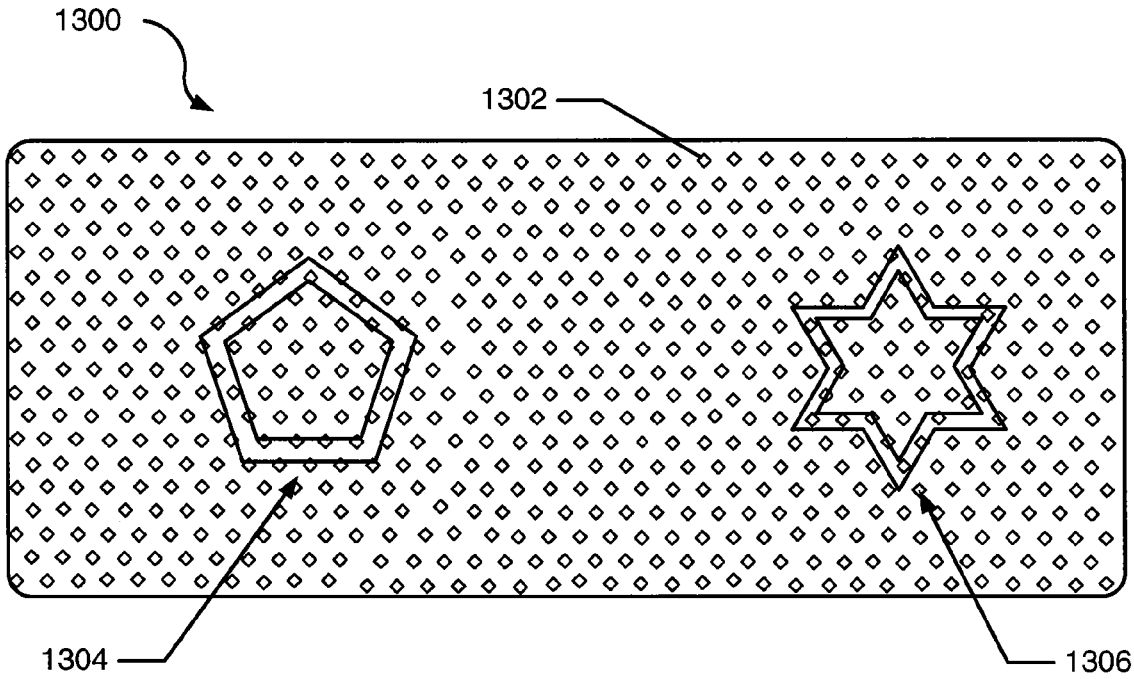

FIGS. 11-13 illustrate examples of additional fabric materials 1100, 1200, and 1300, respectively (the illustrated examples are mesh materials—note mesh openings 1102, 1202, and 1302, respectively) that may be used in example garments in accordance with this invention. FIG. 11 illustrates a fabric 1100 with elliptically shaped fabric surface modifying elements 1104. Notably, these fabric surface modifying elements 1104 include an elliptically shaped annular ring 1106 and an elliptically shaped raised central portion 1108. In the example fabric 1200 of FIG. 12, two different sized fabric surface modifying elements 1204 and 1206 are provided. Of course, any number of different sizes of fabric surface modifying elements may be provided in a single fabric structure 1200, and these different sizes may be arranged in any desired pattern and/or arrangement, including in random patterns or arrangements, without departing from the invention (e.g., see FIG. 10). Like the examples shown in FIGS. 3A, 3B, and 11, these fabric surface modifying elements 1204 and 1206 include an annular outer ring 1208 defining a contact surface for the wearer's body and a raised central portion 1210.

A wide variety of different shapes of fabric surface modifying elements also may be provided in a fabric structure without departing from this invention. FIG. 13 illustrates some examples. Specifically, the fabric structure 1300 includes two illustrated fabric surface modifying elements 1304 and 1306 of different shapes (one star shaped 1306 and one pentagon shaped 1304). Like various examples described above, these fabric surface modifying elements 1304 have annular rings and raised central portions, but this is not a requirement. As still other examples, if desired, the fabric surface modifying elements may be molded and/or arranged into customized designs and shapes, such that one or more of the surface modifying elements, either alone or in combination, form or include words, numbers, phrases, slogans, logos, trademarks, trademarked shapes, and the like, e.g., to include individual team names, manufacturer names, corporate names or logos, etc. as an integral part of the fabric and garment structure.

Figure 16:
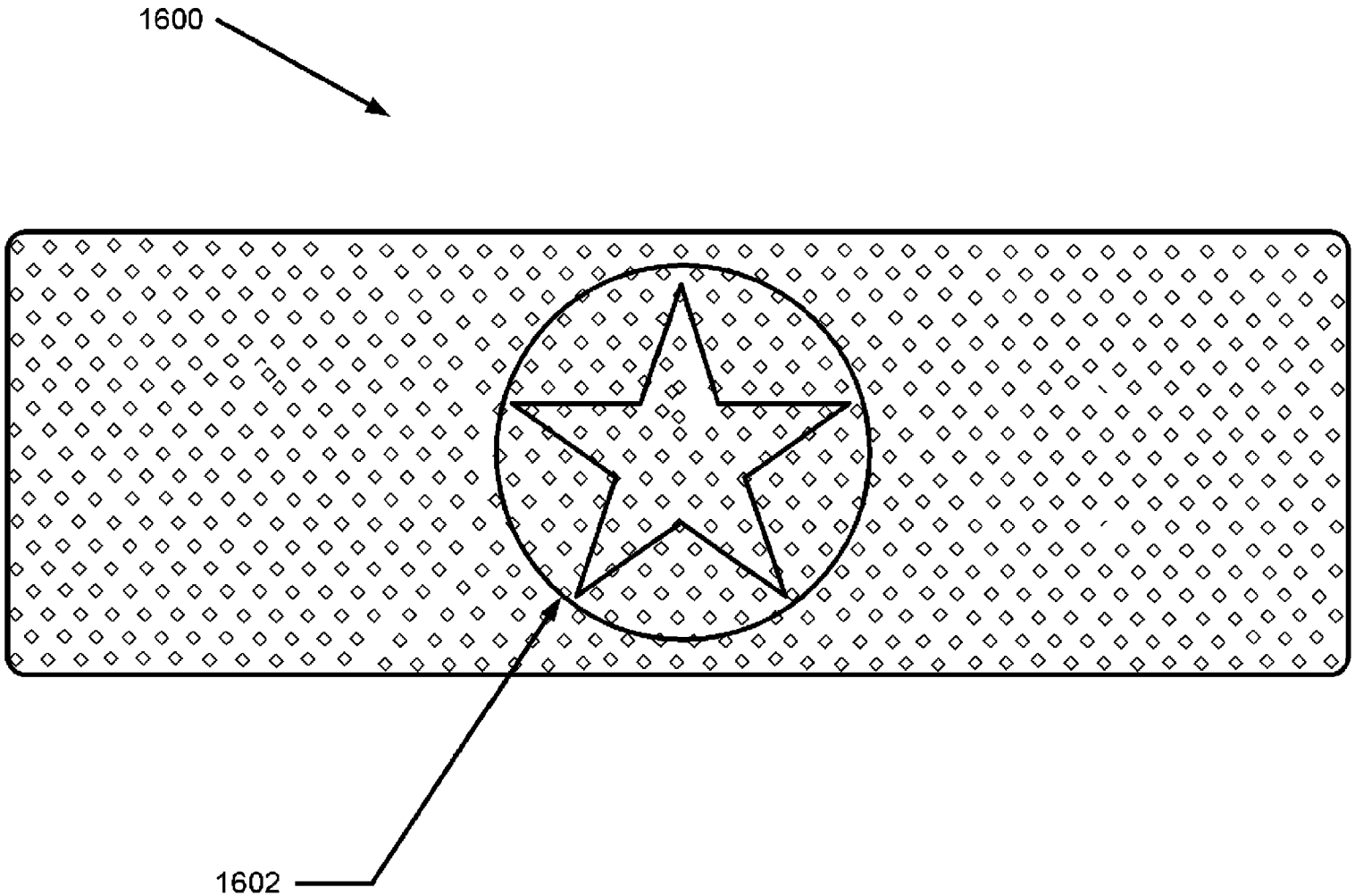

While the examples of FIGS. 11-13 show fabric surface modifying elements having raised central portions, those skilled in the art will recognize, of course, that some or all of the individual surface modifying elements need not have annular contact rings and/or raised central portions. Rather, if desired, the central portions of some or all of these fabric surface modifying elements may be smooth or "unraised" (e.g., as shown in FIGS. 1 through 2B) without departing from this invention. Also, if desired, when raised, the central portion of the surface modifying element need not have the same or similar shape to its outer portion. For example, FIG. 16 is an illustrative embodiment of a fabric structure 1600 with such a surface modifying element 1602.

Also, while the specific example structures above have been described primarily in terms of garments and fabrics made from mesh or other highly gas permeable fabrics, those skilled in the art will understand that the same surface modifying elements and arrangements may be used to provide cool or cold weather fabrics and garments. This can be accomplished, for example, by providing a heavier fabric (e.g., fleece or wool fabrics, etc.) and/or a less gas permeable fabric, and forming the surface modifying elements therein. In this manner, the surface modifying elements will help hold a layer of thermally insulative air between the fabric and the wearer's body, which can help keep the cold air out and/or keep the warm air near the wearer in cool or cold conditions without adding the weight, bulk, and/or wind resistance of additional clothing layers. The fabric material may remain sufficiently gas permeable such that the fabric retains adequate breathability and/or wicks away moisture while still providing heat insulating properties.

Figure 14:
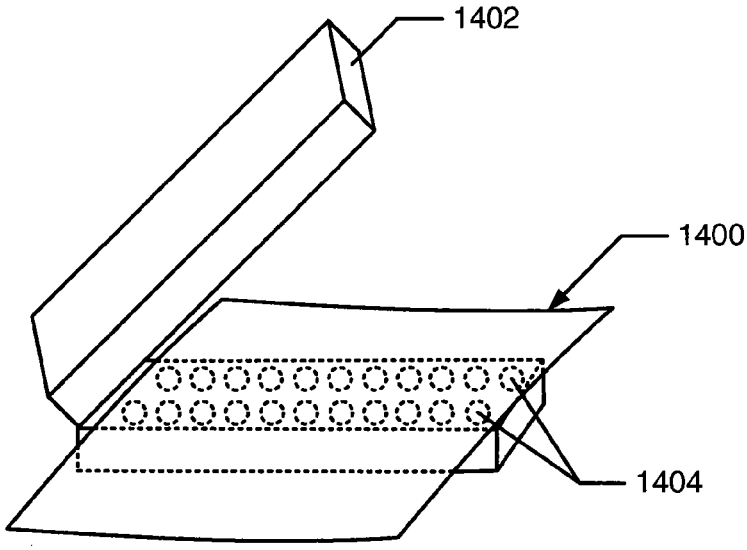

Any way of making fabric including surface modifying elements of the types described above may be used without departing from this invention. In at least some examples of this invention, the fabric material will be formed to include surface modifying elements by embossing and/or molding techniques, as opposed to forming the surface modifying elements by attempting to directly weave or knit surface modifying structures into the overall fabric or garment structure. As one more specific example, as generally illustrated in FIG. 14, an "undimensionalized" fabric material 1400 may be placed in a mold 1402 that includes elements 1404 to produce the desired surface modifying elements in the fabric 1400. Optionally, heat may be applied to the mold 1402 to help form the fabric 1400 into a "dimensionalized" fabric structure, e.g., as shown in the various figures described above (akin to the manner in which creases or pleats can be formed in a fabric structure, e.g., using pressing or ironing techniques). Once removed from the mold 1402, fabric surface modifying elements will remain self-standing in the fabric structure 1400, thereby defining a user or body contact level below the major surface(s) and base level of the fabric 1400. Appropriate molding, heating, pressing, dwell time in the mold 1402, and/or other processing conditions may be readily determined using routine experimentation, dependent, for example, on the type of fabric, its thickness or other characteristics, characteristics of the desired surface modifying elements, and the like. Also, if desired, the fabric may be treated with a suitable material to help the surface modifying elements receive and/or maintain their shape (e.g., sprayed with water or exposed to steam prior to or during molding, treated with a stiffening agent, etc.).

Also, the molding step as described above may take place at any desired time, such as before the fabric 1400 is made part of a garment structure, after the fabric 1400 is included in a garment structure, and/or as part of a garment forming process, without departing from this invention. Any desired size or shape mold also may be used without departing from this invention. The mold also may stretch the fabric somewhat, e.g., in the areas for the surface modifying elements, which can increase inter-fiber distance and also increase gas permeability of the fabric in these regions.

Figure 15:
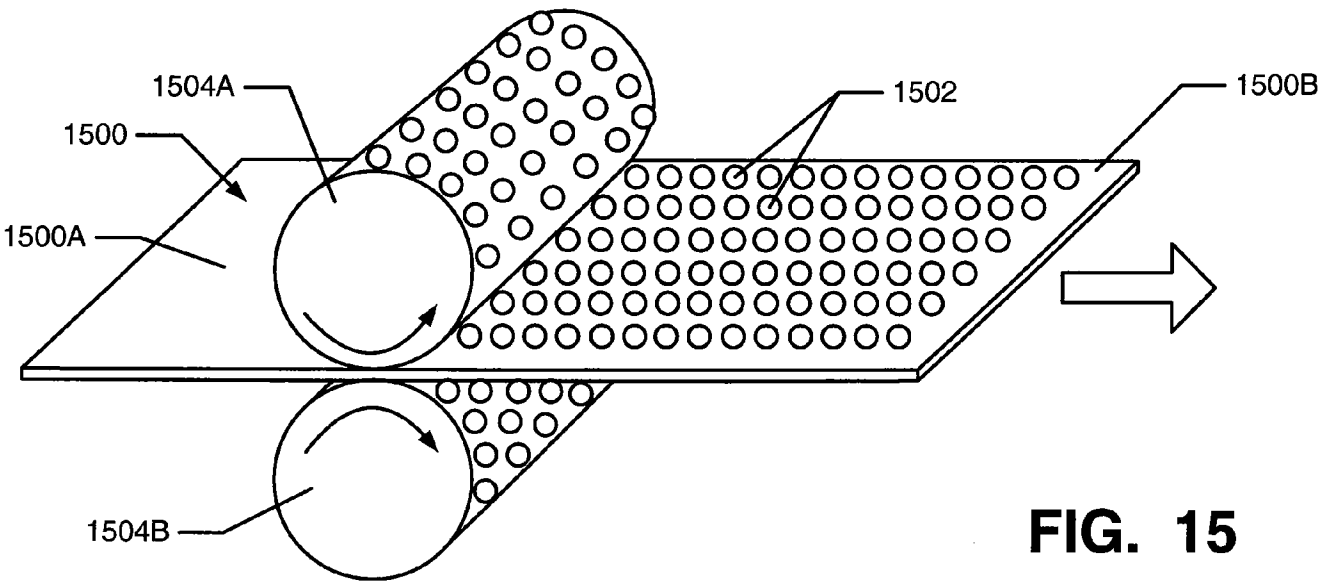
FIGS. 14 and 15 illustrate example processes for forming fabric surface modifying elements in fabrics and/or garments in accordance with at least some examples of this invention.

FIG. 15 illustrates other example methods for forming surface modifying elements 1502 in a fabric material 1500. This figure generically represents various molding, rolling, and/or embossing techniques, e.g., for forming large rolls or bolts of structured materials in continuous or semi-continuous operations. As shown, "undimensionalized" fabric material 1500A (e.g., mesh or other fabric) is passed through a nip between two structured rollers 1504A and 1504B (optionally, if desired, a single roller and/or a single structured roller with an unstructured second roller or contact surface may be used without departing from this invention). After passing through the nip, the fabric 1500 will have the dimensionalized structure 1500B, including the fabric surface modifying elements 1502, as shown in FIG. 15. Once formed in the fabric 1500B, the fabric surface modifying elements 1502 of this example will remain self-standing in the fabric structure 1500B, thereby defining a contact level below the major surface(s) and base level of the fabric 1500. Appropriate molding, rolling, embossing, heating, pressure, roller rotation speed, dwell time, and/or other processing conditions may be readily determined using routine experimentation, dependent, for example, on the type of fabric, its thickness or other characteristics, characteristics of the desired surface modifying elements, and the like. Also, if desired, as described above the fabric 1500 may be treated with a suitable material to help the surface modifying elements receive and/or maintain their shape.

Also, the fabric structure modifying element providing step(s) may take place, for example, before the fabric 1500 is made part of a garment structure, after the fabric 1500 is included in a garment structure, and/or as part of the garment forming process, without departing from this invention. As noted above, however, the procedures generally represented by FIG. 15 are well designed for producing large rolls of "dimensionalized" fabric material.

Dimensionalized fabrics in accordance with examples of this invention may be readily formed into garments and garment structures, e.g., using conventional techniques that are known to those skilled in the art, such as via sewing techniques, etc. Also, an individual garment may contain any desired number of fabric parts that are joined together (e.g., via sewing techniques), and any desired number of the fabric parts may be made from "dimensionalized" material(s). As still additional examples, if desired, some or all portions of a garment structure in accordance with examples of this invention may be made from a mesh material, and, if desired, only certain desired portions of that mesh material may include surface modifying elements or dimensionalizing structures (e.g., portions located in "targeted" regions of the garment corresponding to body regions that release substantial heat, such as along the wearer's central spine, etc.).

Fabric structures in accordance with at least some examples of this invention are advantageous, in at least some instances, because the contact level defined by the surface modifying elements helps keep the fabric up and off the wearer's skin surface. This can promote better air circulation and evaporative cooling (by allowing room for the air to move) and can help prevent cling (e.g., of wet, sweaty fabric) to the wearer's body. Moreover, the resulting material typically can be made lightweight, soft, and generally air permeable. Additionally, if desired, aspects of this invention, including the formation and providing of surface modifying elements, can be applied to existing fabric materials, including fabric materials already incorporated into existing garments, such as mesh and/or non-mesh materials, if desired.

By integrally forming the fabric surface modifying elements from the fabric material in a self-standing fashion (e.g., akin to the manner in which creases or pleats can be formed in fabric in a self-standing manner, e.g., by pressing or ironing techniques, etc.), the fabric material generally remains soft and flexible. If desired, heating of the fabric during surface modifying element formation may change the fabric fiber structure somewhat (e.g., melt it somewhat or cause clumping to some degree), to help provide a stable, long lasting surface modifying element structure that lasts through several uses and/or washing cycles, etc. Integrally forming the fabric surface modifying elements in the base fabric structure provides a single piece structure, without seams or openings, and without hard surfaces that are easy to grab onto (thus making the fabric somewhat grab, rip, and/or tear resistant). The fabric surface modifying elements may freely compress, move, bend, flex, and/or otherwise deform under applied force or pressure (such as stretching, bending, or the like), but they will tend to bounce back to or toward their original structured shape when the force or pressure is removed or reduced.

Of course, a wide variety of variations in the fabric and garment production processes are possible without departing from this invention. Moreover, the various different steps may be changed, changed in order, additional steps may be added, and/or the described steps may be eliminated and/or replaced with other steps or procedures without departing from this invention.

III. Conclusion

Various examples of the present invention have been described above, and it will be understood by those of ordinary skill that the present invention includes within its scope all combinations and subcombinations of these examples. Additionally, those skilled in the art will recognize that the above examples simply exemplify the invention. Various changes and modifications may be made without departing from the spirit and scope of the invention, as defined in the appended claims.

The invention claimed is:

1. A fabric, comprising:

a mesh fabric material forming a fabric base level; and a plurality of separate and distinct self-standing fabric surface modifying elements integrally formed in the mesh fabric material, wherein at least some of the fabric surface modifying elements define a fabric contact level different from the fabric base level, wherein the mesh fabric material includes a first surface and second surface opposite the first surface and wherein the mesh fabric material is defined between the first surface and the second surface, wherein at least some of the plurality of fabric surface modifying elements include at least one wall member extending from the fabric base level toward the fabric contact level and a base wall member extending from said one wall member, the base wall member at least partially defining the fabric contact level, wherein the base wall member has multiple levels including:

a base portion at least partially defining the fabric contact level which includes a contact surface which is included in, and extends along, the first surface of the mesh fabric material, and a raised central portion extending along a center of the base wall member and located at a position other than the fabric contact level and away from the fabric contact level in a direction towards the fabric base level, wherein the raised central portion is included in, and extends along, the first surface of the mesh fabric material.

2. A fabric according to claim 1, wherein the base portion of the base wall member is annular.

3. A fabric according to claim 1, wherein the base wall member includes at least portions of plural mesh openings of the mesh fabric material.

4. A fabric according to claim 1, wherein the at least one wall member includes at least portions of plural mesh openings of the mesh fabric material.

5. A fabric according to claim 1, wherein at least some of the plurality of fabric surface modifying elements are flexible.

6. A fabric according to claim 1, wherein at least some of the plurality of fabric surface modifying elements are deformable from their original shape under an applied force and return toward their original shape when the applied force is removed or reduced.

7. A fabric according to claim 1, wherein the central portion is shaped differently from the exterior shape of the fabric surface modifying element in which it sits.

8. A fabric according to claim 1, wherein the central portion is located at a position other than the fabric base level.

9. A fabric, comprising:

a fabric element formed of a mesh fabric material, wherein the mesh fabric material includes a first surface and second surface opposite the first surface and wherein the mesh fabric material is defined between the first surface and the second surface, wherein the fabric element defines a first major surface and a second major surface opposite the first major surface;

a first self-standing fabric surface modifying element integrally formed in the fabric material, wherein the first fabric surface modifying element extends in a direction from the first major surface toward the second major surface, and wherein at least a portion of the fabric material forming the first fabric surface modifying element extends beyond the second major surface; and a second self-standing fabric surface modifying element integrally formed in the fabric material, wherein the second fabric surface modifying element extends in a direction from the first major surface toward the second major surface, and wherein at least a portion of the fabric material forming the second fabric surface modifying element extends beyond the second major surface, wherein each of the first and second fabric surface modifying elements include at least one wall member extending in the direction from the first surface toward the second surface and a base wall member extending from the wall member, the base wall member at least partially defines a fabric contact level, wherein the base wall member has multiple levels including:

a base portion at least partially defining the fabric contact level which includes a contact surface which is included in, and extends along, the first surface of the mesh fabric material, and a raised central portion extending along a center of the base wall member and located in a position away from the fabric contact level and in a direction toward the first major surface as compared to the base portion, wherein the raised central portion is included in, and extends along, the first surface of the mesh fabric material.

10. A fabric according to claim 9, wherein the first fabric surface modifying element and the second fabric surface modifying element have different shapes.

11. A fabric according to claim 9, wherein the first fabric surface modifying element and the second fabric surface modifying element have different sizes.

12. A fabric according to claim 9, wherein the base portion of the base wall member is annular.

13. A fabric according to claim 9, wherein the wall member includes at least portions of plural mesh openings of the mesh fabric material.

14. A fabric according to claim 9, wherein the base wall member includes at least portions of plural mesh openings of the mesh fabric material.

15. A fabric according to claim 9, wherein the first fabric surface modifying element and the second fabric surface modifying element define at least a portion of a fabric contact surface at a position beyond the second major surface when viewed in the direction from the first major surface toward the second major surface.

16. A fabric according to claim 9, wherein the first fabric surface modifying element is flexible.

17. A fabric according to claim 9, wherein the first fabric surface modifying element is deformable from its original shape under an applied force and returns toward the original shape when the applied force is removed or reduced.

18. A fabric according to claim 9, wherein the central portion is shaped differently from the exterior shape of the fabric surface modifying element in which it sits.

19. A fabric according to claim 9, wherein the central portion extends back toward the first major surface so that it extends beyond one or both of the first or second major surfaces.

20. A garment, comprising:

a first fabric element formed from a mesh fabric material, wherein the mesh fabric material includes:

a fabric base level, and a plurality of self-standing fabric surface modifying elements integrally formed in the mesh fabric material, wherein at least some of the fabric surface modifying elements define a fabric contact level different from the fabric base level, wherein the mesh fabric material includes a first surface and second surface opposite the first surface and wherein the mesh fabric material is defined between the first surface and the second surface, wherein at least some of the plurality of fabric surface modifying elements include at least one wall member extending from the fabric base level toward the fabric contact level and a base wall member extending from said one wall member, the base wall member at least partially defining the fabric contact level, wherein the base wall member has multiple levels including:

a base portion at least partially defining the fabric contact level which includes a contact surface which is included in, and extends along, the first surface of the mesh fabric material, and a raised central portion extending along a center of the base wall member and located at a level different from the fabric contact level and away from the fabric contact level in a direction towards the fabric base level, wherein the raised central portion is included in, and extends along, the first surface of the mesh fabric material.

21. A garment according to claim 20, wherein the base portion of the base wall member is annular.

22. A garment according to claim 20, wherein at least some of the plurality of fabric surface modifying elements are flexible.

23. A garment according to claim 20, further comprising:

a second fabric element joined with the first fabric element.

24. A garment according to claim 23, wherein the second fabric element does not include surface modifying elements.

25. A garment according to claim 20, wherein the first fabric element extends along at least a portion of the garment that covers a wearer's spine.

26. A garment according to claim 20, wherein the first fabric element extends along at least a portion of the garment that covers one of a wearer's sides.

27. A garment according to claim 20, wherein the central portion is shaped differently from the exterior shape of the fabric surface modifying element in which it sits.

28. A garment according to claim 20, wherein the central portion is located at a position other than the fabric base level.

29. A garment, comprising:

a first fabric element formed from a mesh material, wherein the mesh fabric material includes a first surface and second surface opposite the first surface and wherein the mesh fabric material is defined between the first surface and the second surface, wherein the first fabric element defines a first major surface and a second major surface opposite the first major surface, and wherein the first fabric element includes:

(a) a first self-standing fabric surface modifying element integrally formed in the mesh material, wherein the first fabric surface modifying element extends in a direction from the first major surface toward the second major surface, and wherein at least a portion of the mesh material forming the first fabric surface modifying element extends beyond the second major surface, and (b) a second self-standing fabric surface modifying element integrally formed in the mesh material, wherein the second fabric surface modifying element extends in a direction from the first major surface toward the second major surface, and wherein at least a portion of the mesh material forming the second fabric surface modifying element extends beyond the second major surface, wherein each of the first and second fabric surface modifying elements include at least one wall member extending in the direction from the first surface toward the second surface and a base wall member extending from the wall member, the base wall member at least partially defines a fabric contact level, wherein the base wall member has multiple levels including:

a base portion at least partially defining the fabric contact level which includes a contact surface which is included in, and extends along, the first surface of the mesh fabric material, and a raised central portion extending along a center of the base wall member and located in a position away from the fabric contact level and in a direction toward the first major surface as compared to the base portion, wherein the raised central portion is included in, and extends along, the first surface of the mesh fabric material.

30. A garment according to claim 29, wherein the base portion of the base wall member is annular.

31. A garment according to claim 29, wherein the first fabric surface modifying element and the second fabric surface modifying element define at least a portion of a fabric contact surface at a position beyond the second major surface when viewed in the direction from the first major surface toward the second major surface.

32. A garment according to claim 29, wherein the first fabric surface modifying element is flexible.

33. A garment according to claim 29, further comprising:

a second fabric element joined with the first fabric element.

34. A garment according to claim 33, wherein the second fabric element does not include surface modifying elements.

35. A garment according to claim 29, wherein the central portion is shaped differently from the exterior shape of the fabric surface modifying element in which it sits.

36. A fabric according to claim 29, wherein the central portion extends back toward the first major surface so that it extends beyond one or both of the first or second major surfaces.

37. A fabric, comprising:

a fabric material forming a fabric base level; and a plurality of self-standing fabric surface modifying elements molded or embossed into the fabric material, wherein at least some of the fabric surface modifying elements define a fabric contact level different from the fabric base level, wherein the fabric material includes a first surface and second surface opposite the first surface and wherein the fabric material is defined between the first surface and the second surface, wherein at least some of the plurality of fabric surface modifying elements include at least one wall member extending from the fabric base level toward the fabric contact level and a base wall member extending from said one wall member, the base wall member at least partially defining the fabric contact level, wherein the base wall member has multiple levels including:

a base portion at least partially defining the fabric contact level which includes a contact surface which is included in, and extends along, the first surface of the fabric material, and a raised central portion located at a position other than the fabric contact level and extending along a center of the base wall member and away from the fabric contact level in a direction towards the fabric base level, wherein the raised central portion is included in, and extends along, the first surface of the fabric material.

38. A fabric according to claim 37, wherein the base portion of the base wall member is annular.

39. A fabric according to claim 37, wherein at least some of the plurality of fabric surface modifying elements are flexible.

40. A fabric according to claim 37, wherein at least some of the plurality of fabric surface modifying elements are deformable from their original shape under an applied force and return toward their original shape when the applied force is removed or reduced.

41. A fabric according to claim 37, wherein the central portion is shaped differently from the exterior shape of the fabric surface modifying element in which it sits.

42. A fabric according to claim 37, wherein the central portion is located at a position other than the fabric base level.

43. A garment, comprising:

a first fabric element formed from a fabric material, wherein the fabric material includes:

a fabric base level, and a plurality of self-standing fabric surface modifying elements embossed or molded into the fabric material, wherein at least some of the fabric surface modifying elements define a fabric contact level different from the fabric base level, wherein the fabric material includes a first surface and second surface opposite the first surface and wherein the fabric material is defined between the first surface and the second surface, wherein at least some of the plurality of fabric surface modifying elements include at least one wall member extending from the fabric base level toward the fabric contact level and a base wall member extending from said one wall member, the base wall member at least partially defining the fabric contact level, wherein the base wall member has multiple levels including:

a base portion at least partially defining the fabric contact level which includes a contact surface which is included in, and extends along, the first surface of the fabric material, and a raised central portion extending along a center of the base wall member and located at a level different from the fabric contact level and away from the fabric contact level in a direction towards the fabric base level, wherein the raised central portion is included in, and extends along, the first surface of the fabric material.

44. A garment according to claim 43, wherein the base portion of the base wall member is annular.

45. A garment according to claim 43, further comprising:

a second fabric element joined with the first fabric element.

46. A garment according to claim 43, wherein the first fabric element extends along at least a portion of the garment that covers a wearer's spine.

47. A garment according to claim 43, wherein the first fabric element extends along at least a portion of the garment that covers one of a wearer's sides.

48. A garment according to claim 43, wherein the central portion is shaped differently from the exterior shape of the fabric surface modifying element in which it sits.

49. A garment according to claim 43, wherein the central portion is located at a position other than the fabric base level.

* * * * *